US006178598B1

(12) United States Patent
Creely, III et al.

(10) Patent No.: US 6,178,598 B1
(45) Date of Patent: Jan. 30, 2001

(54) ADJUSTABLE HINGE ASSEMBLY

(75) Inventors: Albert L. Creely, III, Glen Mills, PA (US); Gert Berg, Worcester (GB); Andreas A. Bolinas, Claymont, DE (US); David Giles, Long Meadow (GB); Thomas D. Goham, West Chester, PA (US); Thomas E. Hall, Oxford, PA (US); Lynn A. Handley, Downingtown, PA (US); Eli J. Holtman, Narberth, PA (US); Stefan M. Koveal, Glen Mills, PA (US); H. Allen Riblett, Ardentown, DE (US); Wolfgang Strasky, Vienna (AT)

(73) Assignee: Southco, Inc., Concordville, PA (US)

( * ) Notice: Under 35 U.S.C. 154(b), the term of this patent shall be extended for 0 days.

(21) Appl. No.: 09/094,830

(22) Filed: Jun. 15, 1998

Related U.S. Application Data

(63) Continuation-in-part of application No. 08/680,178, filed on Jul. 15, 1996, now Pat. No. 5,765,263.

(51) Int. Cl.[7] ..... E05D 11/08

(52) U.S. Cl. ..... 16/342; 16/244; 16/271; 16/330; 16/303

(58) Field of Search ..... 16/271, 244, 243, 16/245, 260, 262, 268, 342, 381, 386, 330, 303, 304, 329

(56) References Cited

U.S. PATENT DOCUMENTS

| | | | |
|---|---|---|---|
| D. 263,370 | 3/1982 | Bisbing . | |
| D. 263,446 | 3/1982 | Bisbing . | |
| D. 268,733 | 4/1983 | Bisbing . | |
| D. 269,943 | 8/1983 | Bisbing . | |
| D. 278,309 | 4/1985 | Vickers . | |

(List continued on next page.)

FOREIGN PATENT DOCUMENTS

| | | | |
|---|---|---|---|
| 262503 | * 10/1949 | (CH) | 16/244 |
| 376389 | 3/1964 | (CH) . | |
| 329876 | * 12/1920 | (DE) | 16/244 |
| 812652 | * 9/1951 | (DE) | 16/244 |
| 816066 | 10/1951 | (DE) . | |

(List continued on next page.)

OTHER PUBLICATIONS

Positioning Advantage Hinge—Southco, Inc., USA. Catalog p. M–2.
Adjustable Non–corrosive Draw Latch—Southco, Inc., USA. Catalog p. H–16.
Over–center Draw Latch (Series 30)—Southco, Inc., USA. p. H–17.
Metal Lift–Off Hinges (Large)—Southco, Inc., USA Catalog pp. M–12, M–13.
Nylon Lift–Off Hinges—Southco, Inc., USA Catalog pp. M–14, M–15.
No. F6 Concealed Hinge—Southco, Inc., USA Catalog Section M, p. M–2 to M–3.
No. 96 Adjustable Compression Hinges, p. M–4 to M–5.
No. 96 Metal Lift–off Hinges, p. M–6 to M–7.

(List continued on next page.)

*Primary Examiner*—Chuck Y. Mah
(74) *Attorney, Agent, or Firm*—Paul & Paul

(57) ABSTRACT

An adjustable hinge assembly for swingably joining hinging panel members together, where improved mounting capability is provided, and adjustability of a pin and the hinge components in multiple directions relative to the hinging panels and to each other is provided, where a base member is mounted to a first hinging member and a pin-carrying member is connected to the base, and a base member mounted to a second hinging member and maintains an adjustable pin-receiving component thereon. Stops are provided to regulate the pivot of the members over a predetermined range.

83 Claims, 25 Drawing Sheets

U.S. PATENT DOCUMENTS

| | | | | |
|---|---|---|---|---|
| D. 284,931 | | 8/1986 | Bisbing . | |
| D. 303,491 | | 9/1989 | Bisbing . | |
| D. 303,492 | | 9/1989 | Bisbing . | |
| D. 339,051 | | 9/1993 | Bisbing . | |
| D. 339,052 | | 9/1993 | Bisbing . | |
| D. 339,281 | | 9/1993 | Bisbing . | |
| D. 339,518 | | 9/1993 | Bisbing . | |
| D. 344,667 | | 3/1994 | Riblett et al. . | |
| D. 348,823 | | 7/1994 | Bisbing . | |
| 1,001,112 | * | 8/1911 | Wrikeman | 16/271 |
| 1,092,236 | * | 4/1914 | Wrikeman | 16/271 |
| 1,469,525 | * | 10/1923 | Nadolney | 16/271 |
| 1,481,142 | * | 1/1924 | Minton et al. | 16/271 |
| 1,863,889 | | 6/1932 | Wells . | |
| 2,097,651 | * | 11/1937 | Stangeland | 16/330 |
| 2,591,476 | | 4/1952 | Swanson . | |
| 2,611,921 | * | 9/1952 | Weidelstam | 16/244 |
| 3,000,049 | | 9/1961 | Terry, Jr. . | |
| 3,805,324 | * | 4/1974 | Johnson | 16/244 |
| 3,874,268 | | 4/1975 | McCullough . | |
| 4,073,037 | | 2/1978 | Curry et al. . | |
| 4,439,888 | | 4/1984 | Merillat . | |
| 4,490,884 | | 1/1985 | Vickers . | |
| 4,501,045 | | 2/1985 | Boyer . | |
| 4,540,206 | | 9/1985 | Frame et al. . | |
| 4,570,291 | | 2/1986 | Smith et al. . | |
| 4,630,333 | | 12/1986 | Vickers . | |
| 4,827,568 | * | 5/1989 | Ramsauer | 16/260 |
| 4,847,950 | | 7/1989 | Coleman . | |
| 4,863,062 | * | 9/1989 | Holliday | 16/262 |
| 4,897,873 | | 1/1990 | Beutler . | |
| 4,987,640 | | 1/1991 | Lin . | |
| 5,020,189 | | 6/1991 | Grome . | |
| 5,040,268 | | 8/1991 | Knurr . | |
| 5,150,500 | | 9/1992 | Bisbing . | |
| 5,398,378 | * | 3/1995 | Lin | 16/330 |
| 5,409,297 | | 4/1995 | DeFeilippo . | |
| 5,412,842 | | 5/1995 | Riblett . | |
| 5,485,655 | | 1/1996 | Wang . | |
| 5,704,094 | * | 1/1998 | Hartigan et al. | 16/303 |
| 5,724,704 | * | 3/1998 | Seo | 16/271 |

FOREIGN PATENT DOCUMENTS

| | | | | |
|---|---|---|---|---|
| 0647756A1 | | 9/1994 | (EP) . | |
| 1321501 | | 2/1963 | (FR) . | |
| 404854 | | 2/1934 | (GB) . | |
| 2052618 | | 1/1981 | (GB) . | |
| 2097465 | | 4/1982 | (GB) . | |
| 2125497 | | 3/1984 | (GB) . | |
| 2193528 | | 2/1988 | (GB) . | |
| 2224538 | | 5/1990 | (GB) . | |
| 1391215 | | 4/1995 | (GB) . | |
| WO 88/0027 | | 1/1988 | (IT) . | |
| 103617 | * | 1/1942 | (SE) | 16/342 |

OTHER PUBLICATIONS

No. 96 Mini Lift–off Hinges—Southco, Inc., USA. Catalog p. M–8 to M–9.

No. 96 Nylon Lift–off Hinges—Southco, Inc., USA. Catalog p. M–10 to M–11.

No. E6 Adjustable Hinges—Southco, Inc., USA. Catalog p. M–12 to M–13.

No. C6 Door Positioning Hinge—Southco, Inc., USA. Catalog p. M–14.

3D–Hinge (C233)—EMKA, Germany.

Hinge 3D—Dirak GmbH & Co., Germany. (Catalog p.4–350).

Screw–On Hinge—Dirak GmbH & Co., Germany. (Catalog p.4–355).

Aximat Series Hinges—HAFELE (Brochure cover, pp. 2 and 8).

Bronson Slip Hinges—Bronson (Catalog 80).

Furniture Hardware—Hettich International (Brochure cover, and pp. 7, 4.45, 4.3).

Concealed Hinges (102 Series)—LAMP, Sugatsune America, Inc. (Brochure cover and p. 4).

Prime Line Window & Door Replacement Hardware N–6706 (119–98).

HAMDQA Three–Way Mounting Plate Kit for Euro–Concealo Hinges, Liberty Hardware Manufacturing Co., Copyright 1996.

* cited by examiner

ADJUSTABLE HINGE ASSEMBLY

CROSS-REFERENCE TO RELATED APPLICATIONS

This is a continuation-in-part of U.S. application Ser. No. 08/680,178, filed on Jul. 15, 1996, issued on Jun. 16, 1998 as U.S. Pat. No. 5,765,263, the complete disclosure of which is herein incorporated by reference.

BACKGROUND OF THE INVENTION

1. Field of the Invention

This invention relates generally to the field of hinges for supporting doors, panels, lids, covers and the like and, more particularly, to hinge devices which can be adjustably provided for mounting to a door or other supporting member.

2. Brief Description of the Prior Art

Lift-off hinge assemblies are known in the art and are particularly useful for securing a door, cover or the like to a frame or other hinging surface. However, one problem associated with the use of these types of hinges is the inability to make adjustments to accommodate door assemblies which employ gaskets or other seals between the frame and the door. In such circumstances, it is advantageous to have an adjustable hinge in order to accommodate a range of thicknesses of the gaskets and to maintain the gasket under compression, even if the gasket should undergo a change in thickness due to continuous compression during use. Adjustable hinges are needed to solve the problems associated with such hinge applications.

One type of hinge used in the art includes lateral slots as mounting apertures for mounting a hinge knuckle to the closure member, thus permitting side-to-side adjustment of the knuckle, which, in turn, varies the distance between the closure member and its frame. Another known adjustable hinge employs a two-piece base assembly in which the base of the two piece assembly is affixed to the closure member and second piece of the base is mounted to the first piece. The two pieces of the base are designed such that they are allowed to be adjusted with respect to each other before tightening.

Other hinge types, though not adjustable, feature shims which are used for spacing the axis of rotation from the frame.

One problem with prior art hinges is that when adjustment of the hinge is desired, while the hinge is still supporting the door, it is very difficult due to the load of the door. Misalignment can occur if the door hinge is not properly seated. This often requires loosening or removing the hinge and then re-tightening or securing it.

A need exists for a hinge that can be adjusted to accommodate various size panel installations, and which can be used with various gasketed door panels. There also exists a need to provide the adjustable features where the door panel can be mounted from a variety of positions, including perpendicular, coplanar or collinear, and from different directions.

It is also known to employ various types of hinge devices which operate to retain a door, lid, cover and the like, in an opened or closed position are known. For example, some types of hinge devices, including, in particular, those employed on vertically swinging kitchen cabinet doors, exert a torque to retain the door in a closed position. However, in certain circumstances, the amount of torque provided from the hinge is insufficient to maintain the door in a closed position, such as, for example, in response to inadvertent contact forces. Many of these types of hinges do not function to permit the door to remain in an open position. Another type of hinge known is used on vertically swinging doors and incorporates a wave-shaped cam surface which allows the door to rest in either an opened or closed position. However, the opened or closed positioning of the hinge is limited to the location of the downward sloped portion of the cam surface. In addition, the application of the hinge is limited to vertically swinging doors since the weight of the door on the cam surface functions to position the hinge. Still, another type of hinge in common use incorporates an adjustable knuckle member which generates a torque upon a hinge pin in order to retain a vertically or horizontally swinging door in an opened position. However, the torque which is generated by adjustment of a screw member creates drag throughout the entire range of motion of the hinge. In addition, the hinge has a tendency to spring open slightly when the door is closed, thereby necessitating an additional latch to retain the door in the closed position.

Another type of hinge is shown in U.S. Pat. No. 5,412,842 to Allen Riblett and assigned to the assignee of the present invention, the complete disclosure of which is herein incorporated by reference. U.S. Pat. No. 5,412,842 is directed to a detent hinge for use with either vertically or horizontally swinging doors. The detent hinge incorporates detent balls and coil springs which operate to bias the detent balls in the direction of a pin assembly. The pin assembly is provided with a number of openings provided within its surface into which the detent balls are adapted to be received for retaining the door in a detent position relative to the frame. The detent hinge also incorporates means for adjusting the amount of torque which is required to move the hinge out of its detent positions, which is accomplished by varying the size, strength and/or number of coil springs and detent balls within the hinge. For this purpose, the detent hinge is provided with a removable retaining member which is opened to gain access for adjusting the amount of torque provided by the coil springs and detent balls. There have, however, been certain limitations noted with this particular detent hinge. One limitation is that the hinge must be of a sufficiently large enough size due to the arrangement of the coil springs and detent balls with the device. Accordingly, there is a limit in the types of applications that this particular detent hinge can be used; specifically, such hinge can not be used in certain applications where a small hinge would be required, such as with smaller doors or where space for mounting the hinge would be limited. Another limitation is that the detent hinge can be susceptible to corrosion due to the particular materials of the device; in particular, due to the coil springs and detent balls which are preferably manufactured of metal. For this same reason, the relative costs to manufacture the device can be higher since components manufactured of metal are utilized.

An "Adjustable Lift-Off Hinge" is disclosed in U.S. Pat. No. 5,150,500 to Robert H. Bisbing, assigned to the assignee of the present invention, the complete disclosure of which is herein incorporated by reference. This hinge assembly employs a longitudinal adjustable knuckle member which is rotatably coupled to a support member along the longitudinal axis, and a longitudinal fixed base member having a convex outer surface pivotally connected to a longitudinal side of the adjustable knuckle member.

A need exists for providing a hinge assembly which can be utilized for applications where panel mounting surfaces are parallel to each other, or even coplanar with each other. Such situations generally do not permit a perpendicular positioning of the members on which the hinge components are to be mounted. A need therefore exists to provide a hinge assembly which can be utilized in installations where one panel is either parallel or coplanar to another panel.

In addition, hinge installation generally requires that panels which are to carry the hinge components be precisely aligned to permit uninhibited swinging of the panel, and operation of the hinging mechanism, by eliminating interference from the stress or imbalance of an improperly positioned hinge or panel. A need exists for a versatile hinge mechanism which permits adjustment of the hinge components relative to vertical and horizontal directions.

In addition, there are generally limitations on the mounting of known hinges. For example, in some prior art type hinges, mounting of the hinge components requires particular orientation of the panels. In some instances, for example, hinges can only be mounted to a mounting surface in one direction, from the front or from the rear, but not either direction. Such devices do not meet the needs of installations requiring mounting from a specified direction relative to the hinge operation. There further exists a need for a versatile hinge assembly which provides greater adaptation for mounting the hinge onto a door panel.

SUMMARY OF THE INVENTION

The present invention provides a novel hinge assembly which is adjustably for installations to a first panel which is to be swingably maintained in relation to a second panel. For example, a door panel and a frame is an application for which the present invention can be utilized. The hinge assembly has a first component which is mounted to a door, and a second component which is mounted to a doorframe or other panel. The hinge assembly provides elements which can be regulated to accommodate a variety of door installations. For example, the hinge assembly can include elements which facilitate adjustment of the hinge by controlling one or more of the hinge components which are to be mounted on a door or panel.

A mounting element is provided to be mounted on each panel which is to be connected by the hinge. A pin-carrying member is attached to one of the mounting elements and a pivot member to the other mounting element. The present invention facilitates installation by providing the ability to install the mounting member to the panel, and then install the hinge pivot members to the mounting members. Adjustment features are also provided whereby one or more of the pivot and pin members attached to the mounting element can be aligned for proper orientation with respect to a panel or another of these members. A vertical adjustment of the pin member can be performed relative to the other members. Further, the pivot member can be adjusted vertically and laterally to properly position the hinge components for receipt of the pin within the pivot member.

A positioning element can also be provided to align with an element disposed in or located on a frame or panel to facilitate proper seating of one or more of the hinge components.

An object of the present invention is to provide a hinge assembly which is adjustable in relation to the panels which the hinge is to operate in conjunction therewith.

A further object of the present invention is to provide a mechanism for facilitating the alignment of the hinge assembly.

A further object of the present invention is to provide a hinge which is adjustable over a range of vertical positions.

Another object of the present invention is to provide a hinge which is adjustable in along the axial length of a panel, and perpendicular with respect to the door hinge axis.

It is a further object of the present invention to provide a hinge with improved installation features for mounting to surface or panel.

Another object of the present invention is to accomplish the above objects, wherein a hinge includes a plurality of stops for maintaining a hinging panel in various positions between fully opened and fully closed.

It is another object of the present invention to accomplish the above objects wherein a separately securable mounting member can be attached to a panel to mount one or more hinge parts thereto.

It is another object of the present invention to accomplish the above objects by providing a novel hinge has improved resistance to dust and debris.

Another object of the present invention is to provide a hinge which can be constructed by snap-fit installation of parts to a mounted member.

It is a further object of the present invention to accomplish the above objects by providing an adjustable pivot member.

A further object of the present invention is to accomplish the above objects wherein the hinge assembly is configured as a lift-off hinge assembly.

BRIEF DESCRIPTION OF THE DRAWING FIGURES

Figure 16A:
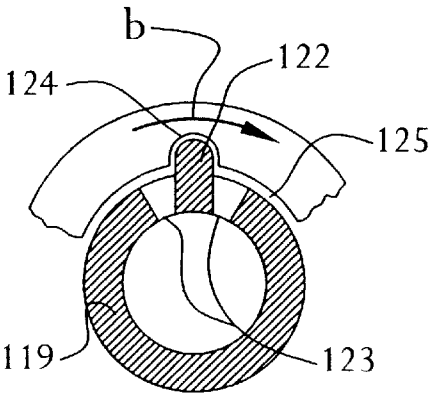
FIG. 16 is a parallel perspective view of an alternate embodiment of a pin member according to the present invention.
Figure 16B:
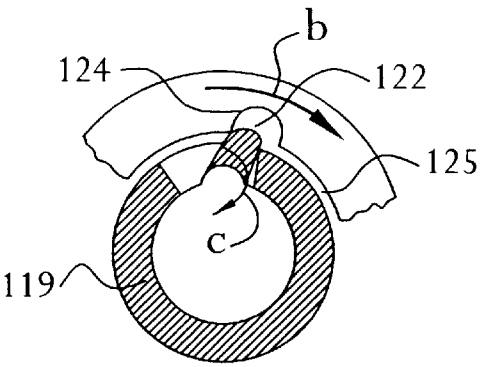
Figure 16:
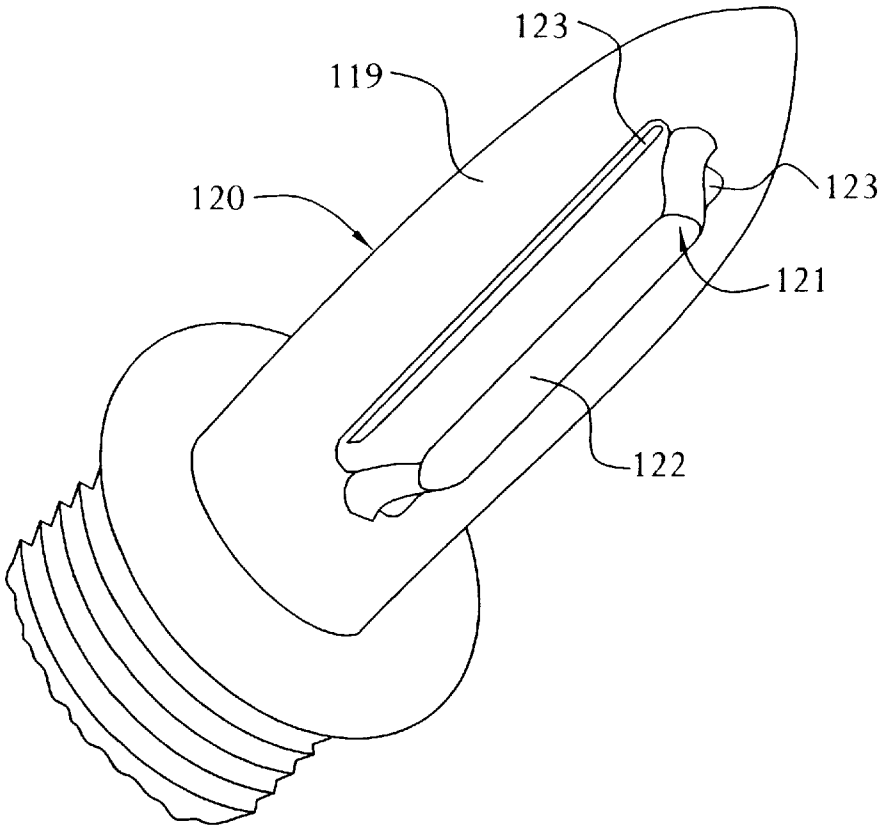

FIG. 16*a* is radial cross-sectional view of a bore of a pivot knuckle with the pin member of FIG. 16 shown received in a bore of a pin knuckle member with the pawl means extended into the receiving detent.

FIG. 16*b* is a radial cross-sectional view of a bore of a pivot knuckle with the pin member of FIG. 16 shown received in a bore of a pin knuckle member with the pawl means retracting from the receiving detent.

Figure 17:
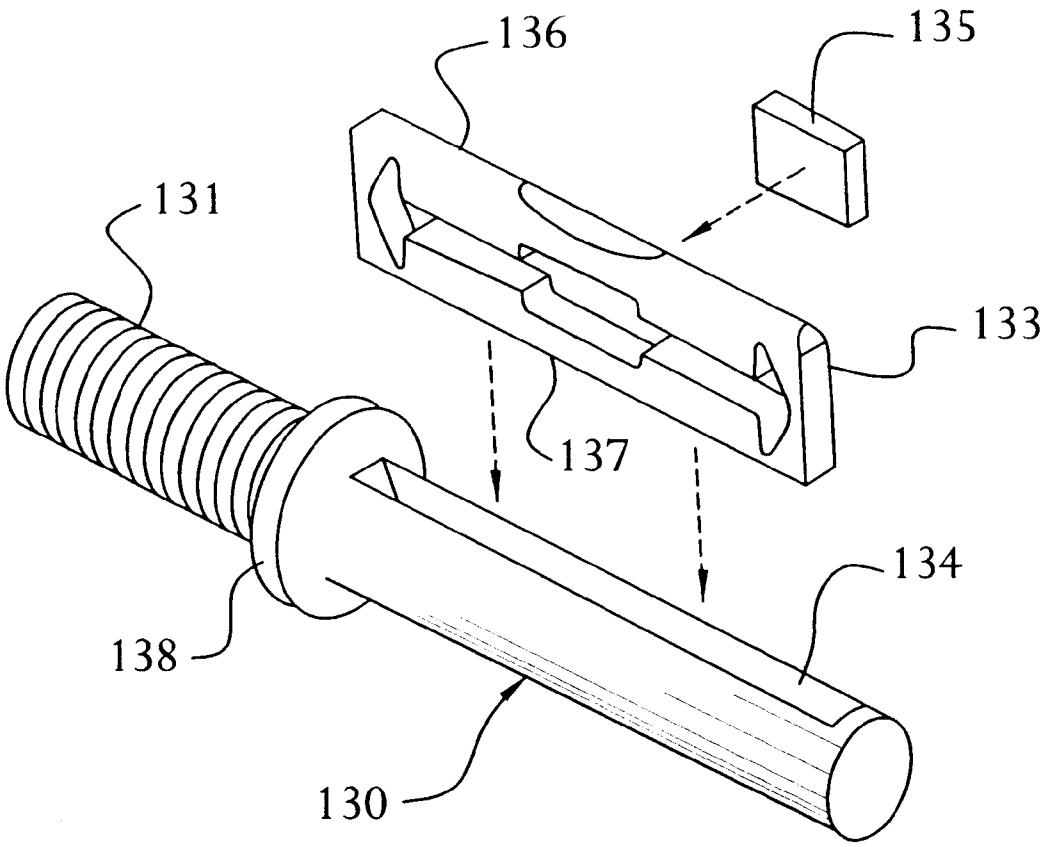

FIG. 17 is an exploded, right side, parallel perspective view of an alternate pin member embodiment in accordance with the present invention.

Figure 18:
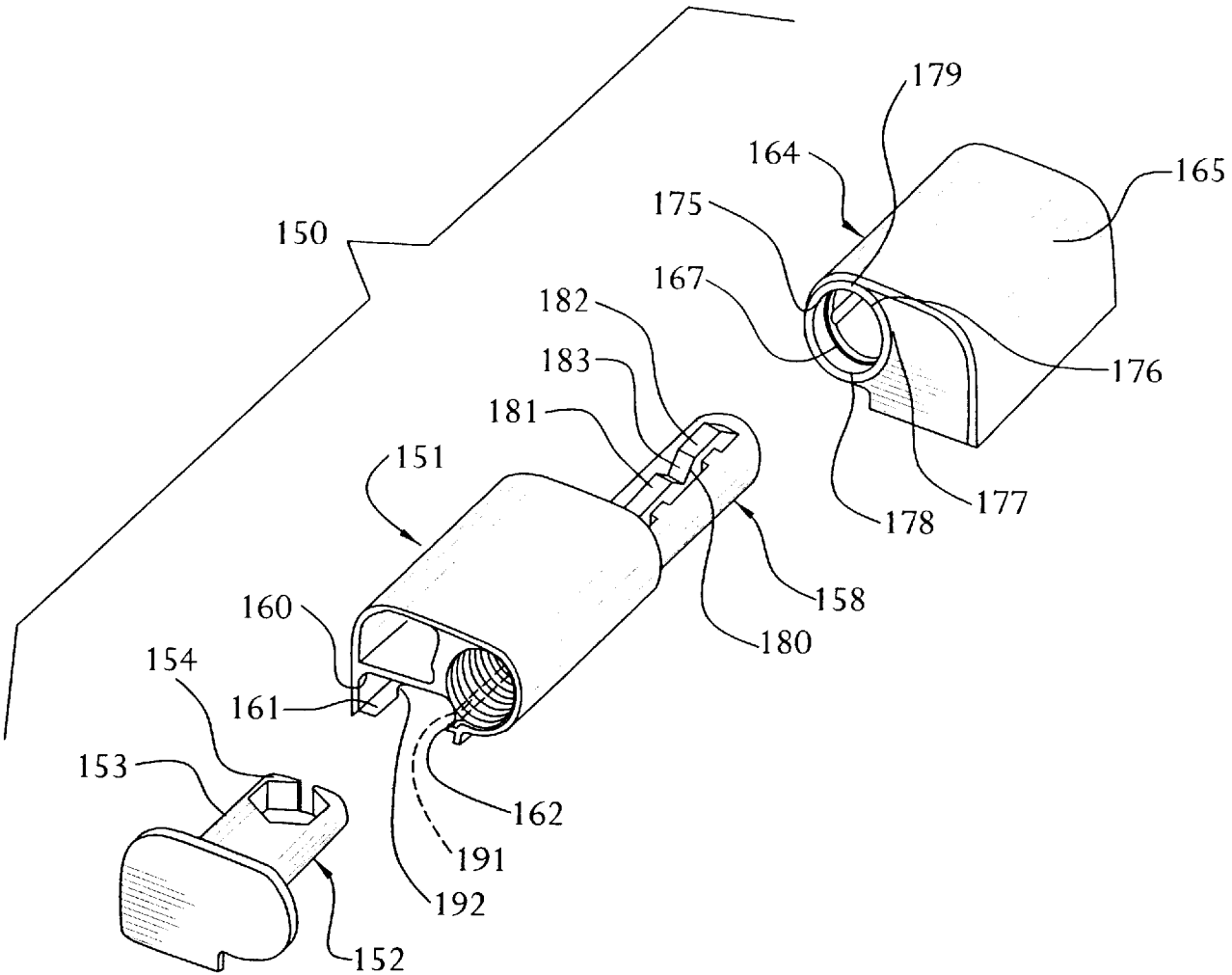

FIG. 18 is an exploded parallel perspective view of an alternate embodiment of a latch assembly according to the present invention.

Figure 19:
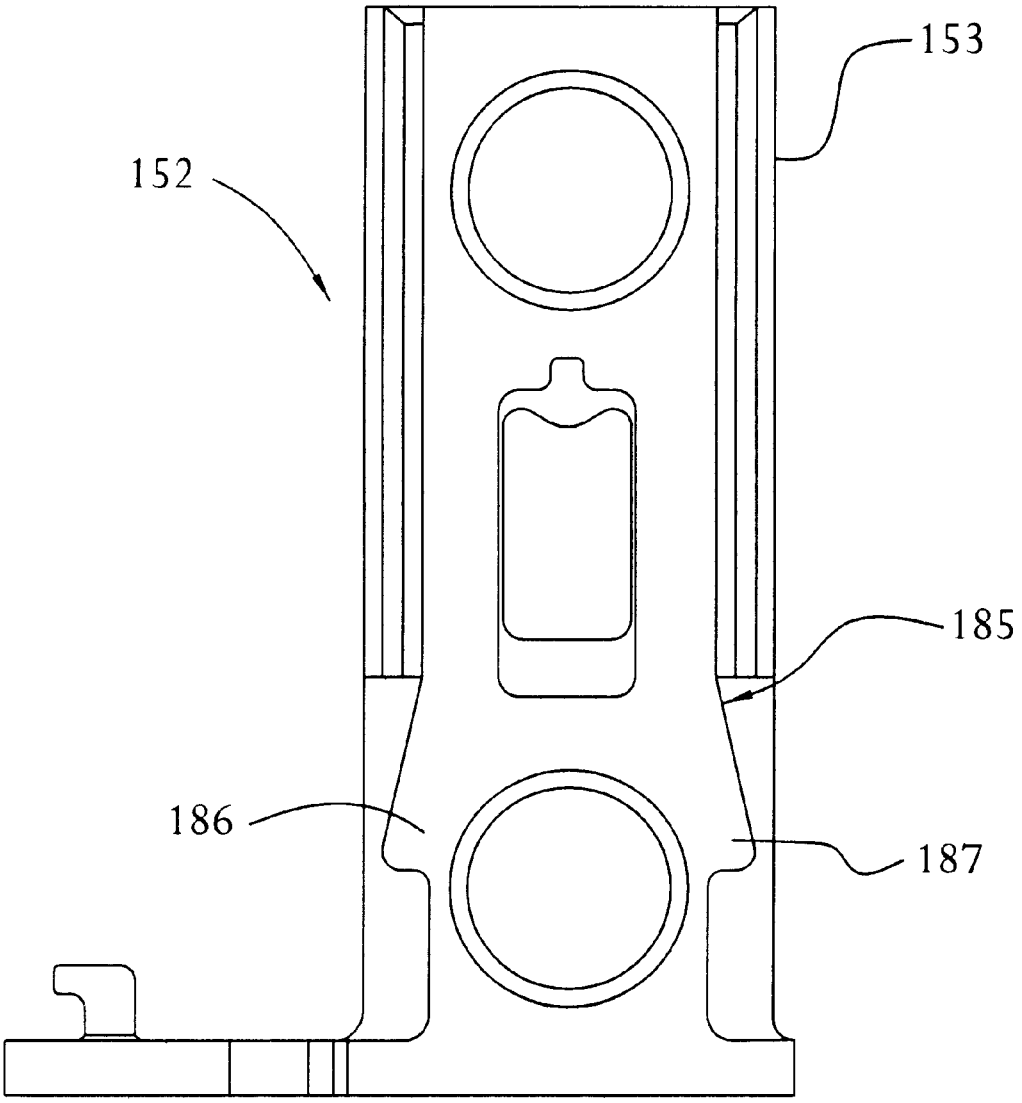

FIG. 19 is a bottom plan view of the base member shown in FIG. 18.

Figure 20:
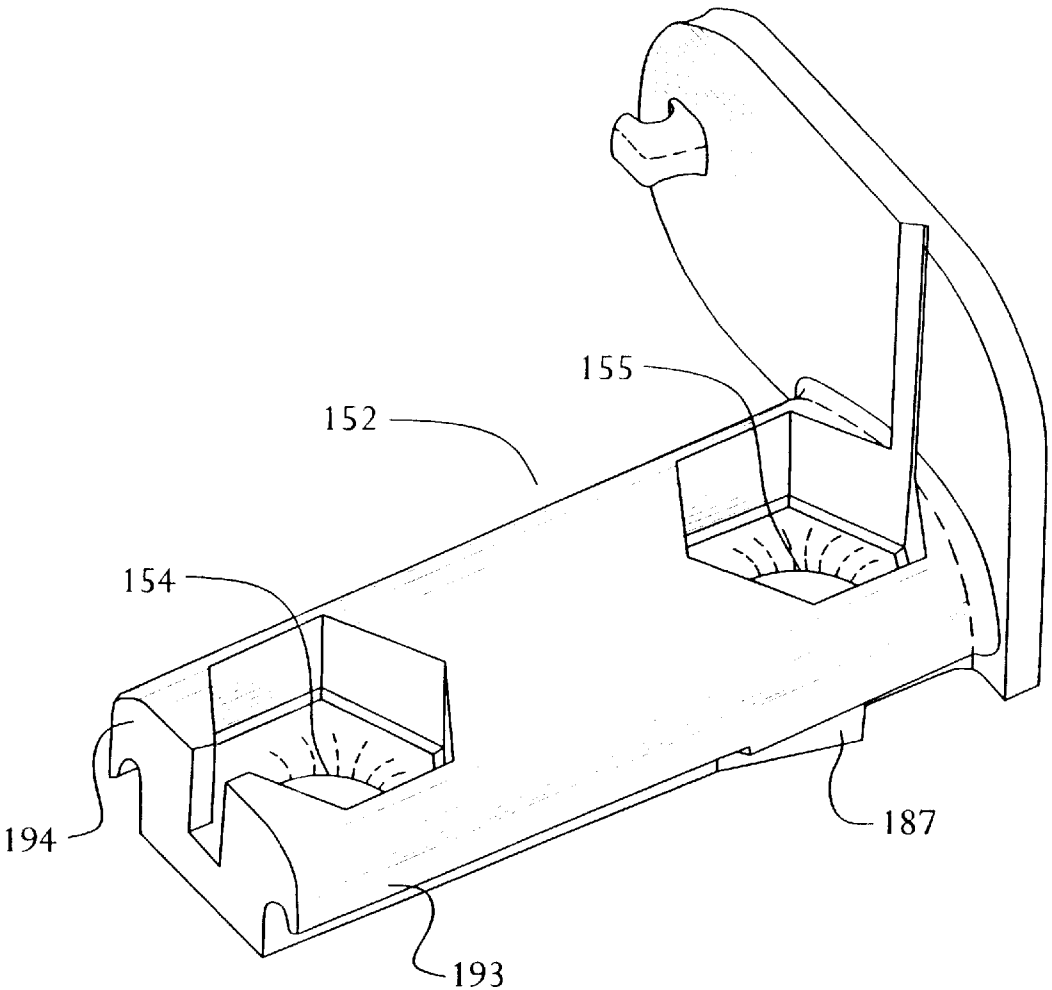

FIG. 20 is a left side, parallel perspective view of the base member of FIG. 19.

Figure 21:
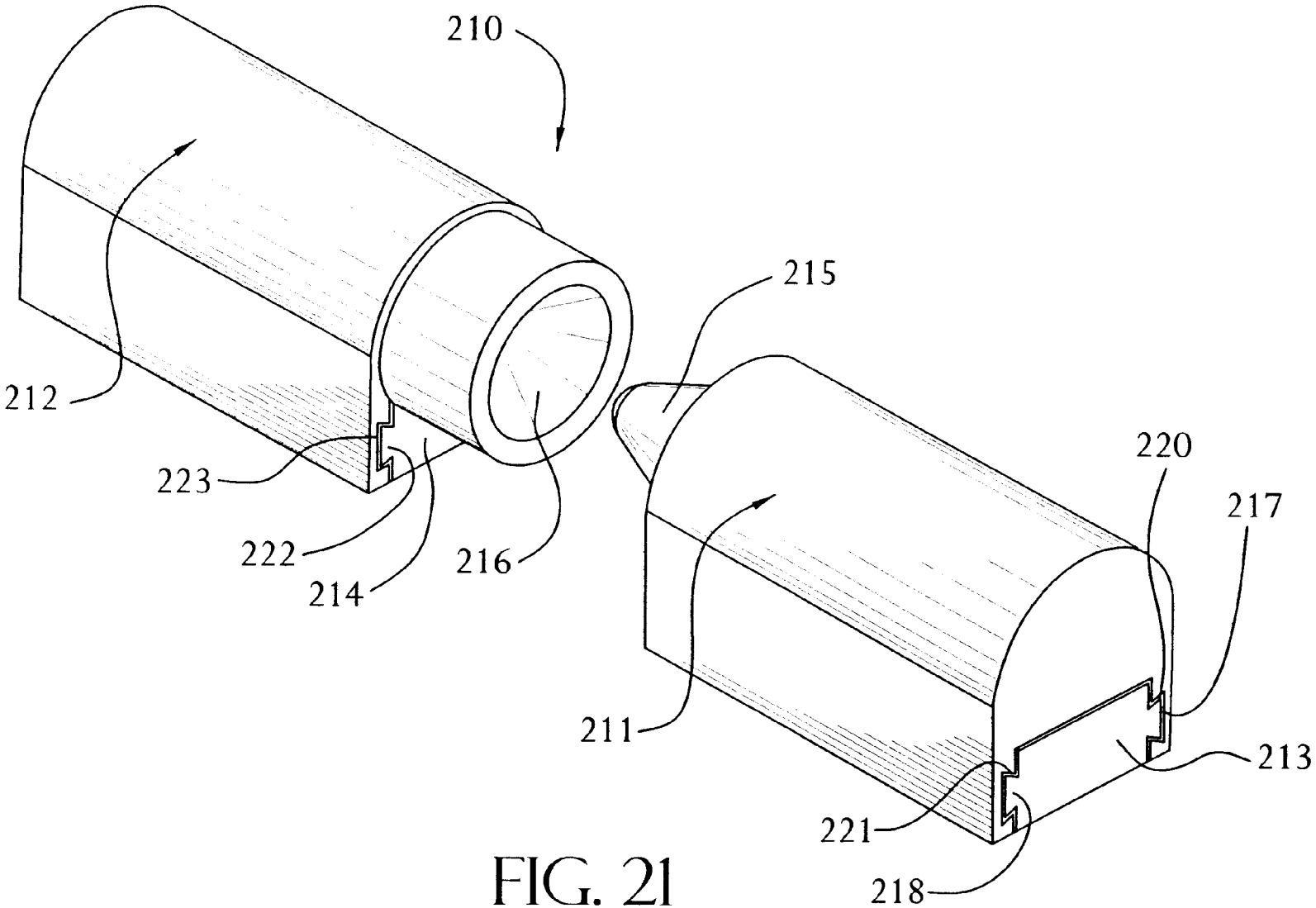

FIG. 21 is an alternate embodiment of a hinge assembly according to the present invention.

Figure 22:
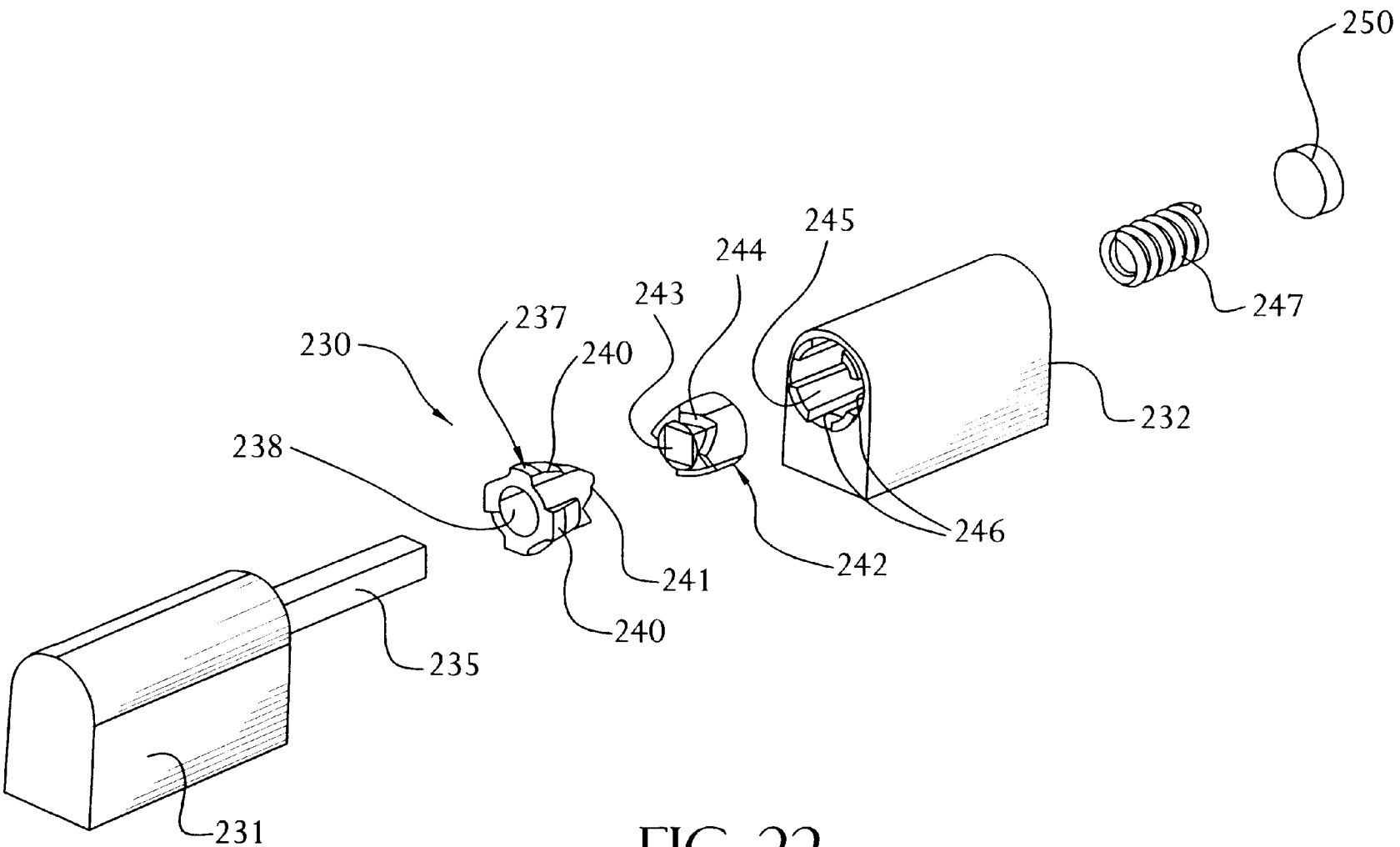

FIG. 22 is an exploded, left side, parallel perspective view of an alternate embodiment of a hinge assembly according to the present invention.

Figure 23:
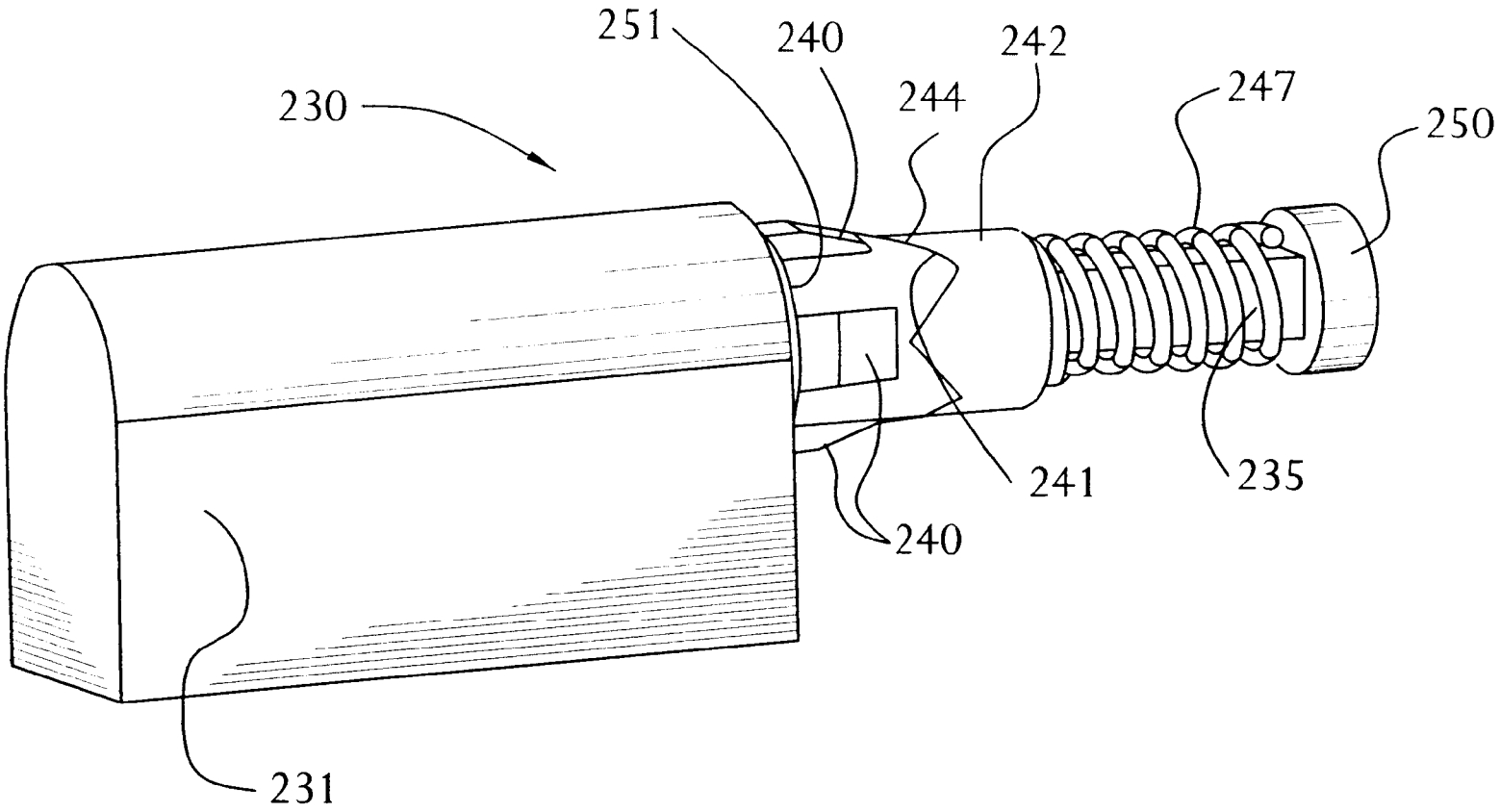

FIG. 23 is a left side, parallel perspective view of the hinge assembly of FIG. 22, showing the assembly of the components on the pin.

Figure 24:
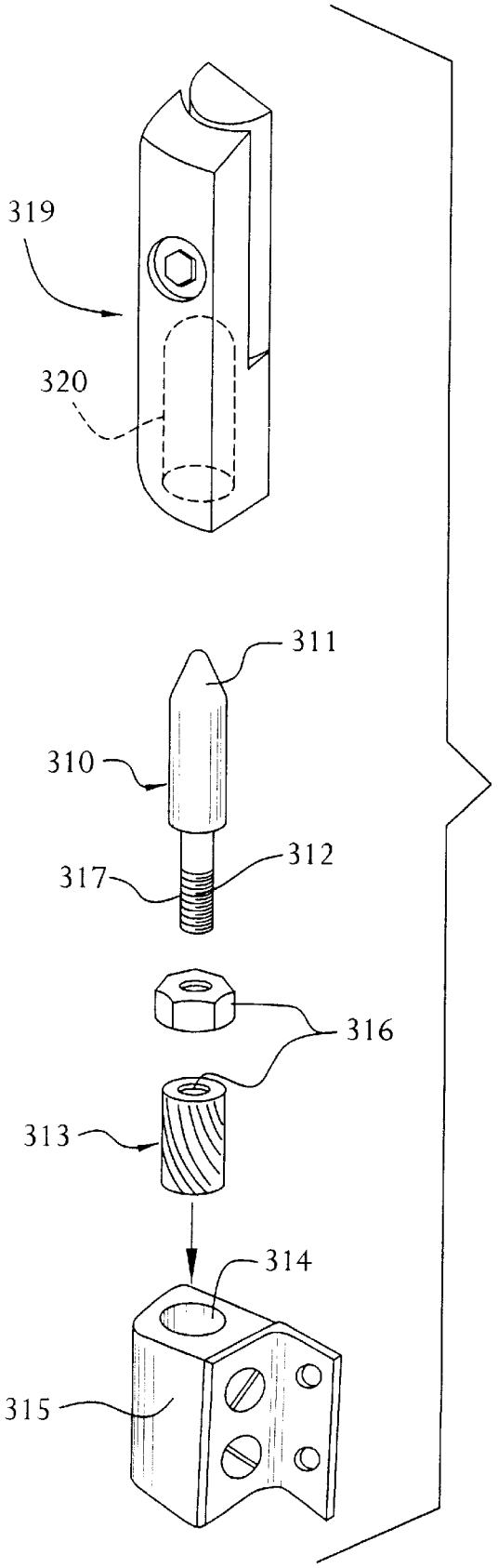

FIG. 24 is another alternate embodiment of a hinge assembly according to the present invention, showing an alternate pin adjustment assembly in an exploded view with a pivot knuckle.

Figure 25:
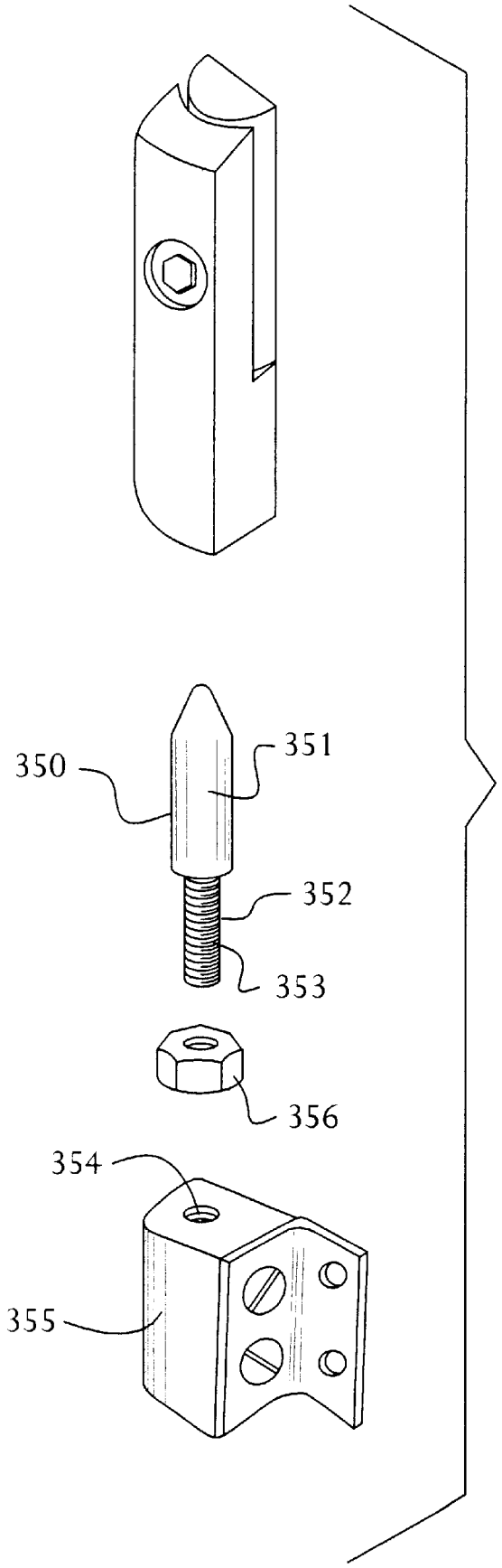

FIG. 25 is yet another alternate embodiment of a hinge assembly according to the present invention, showing an alternate pin adjustment assembly in an exploded view with a pivot knuckle.

DETAILED DESCRIPTION OF THE PREFERRED EMBODIMENTS

Figure 1:
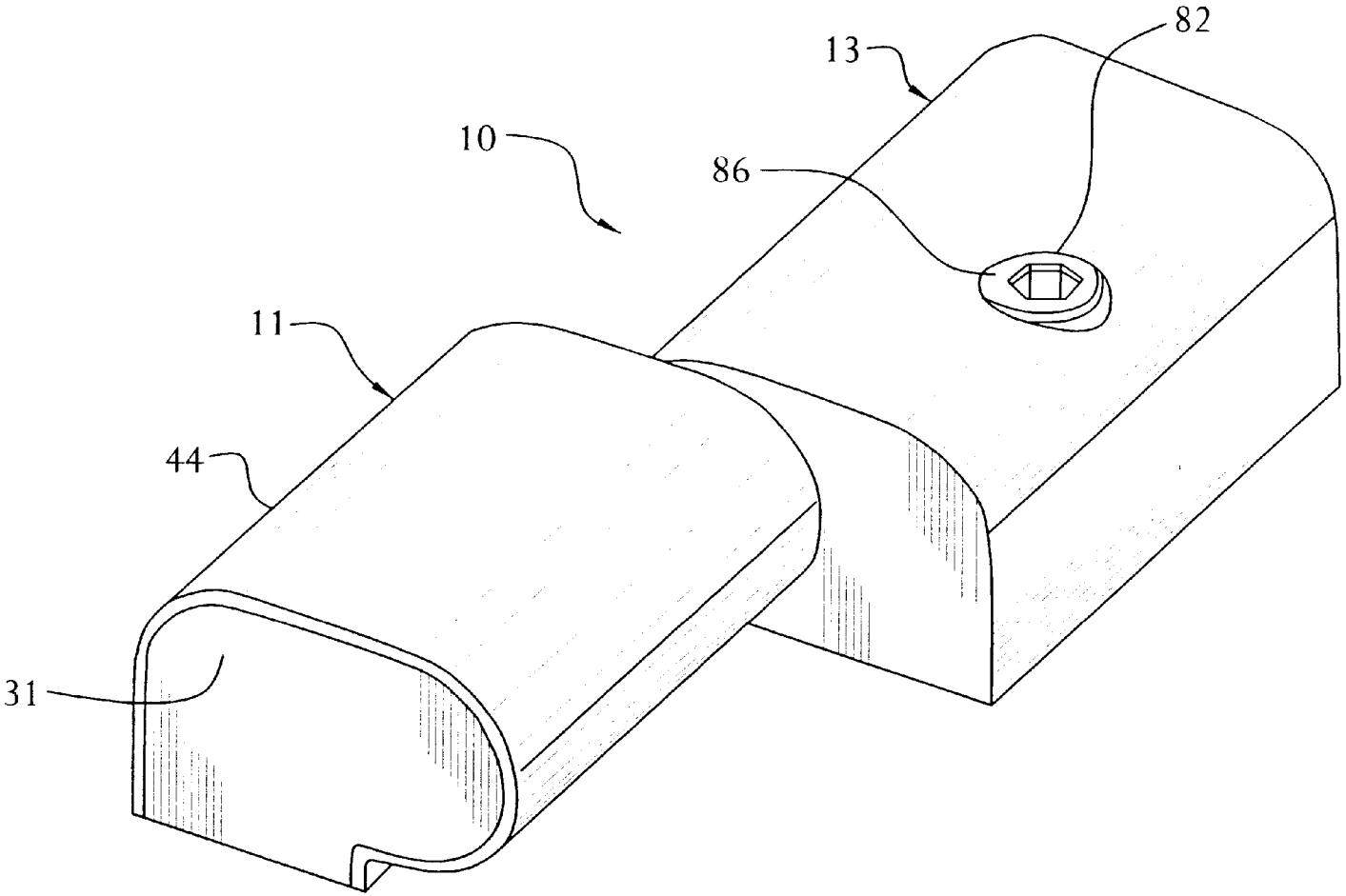
FIG. 1 is a left side, parallel perspective view of a hinge assembly according to the present invention.

Referring to FIG. 1, a preferred embodiment of an adjustable hinge assembly 10 according to the present invention is shown. The hinge assembly 10 has receiving means and insert means which are rotatable relative to each other to provide hinging action when each component is installed on a panel. In a preferred installation, one of the receiving means and the insert means can be installed on a door panel (not shown) with the other being installed on a doorframe (not shown). The insert means is shown comprising the pin knuckle 11 which includes a pin 12 extending therefrom (FIG. 2) which is received in a socket of the receiving means, shown comprising the pivot knuckle 13.

Figure 2:
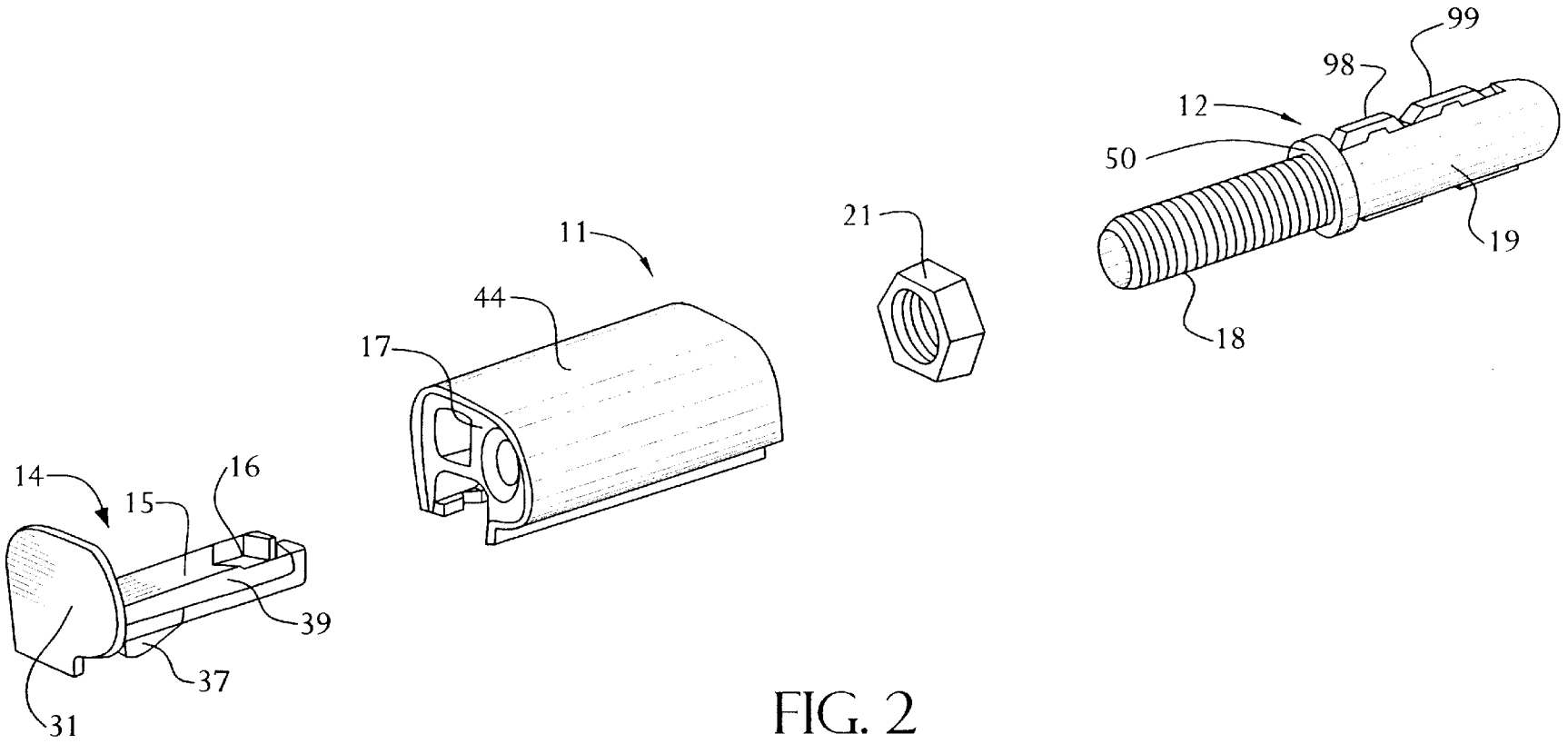
FIG. 2 is an exploded, parallel perspective view of the pin knuckle and base member of the hinge assembly shown in FIG. 1.

FIG. 2. shows the hinge assembly 10 in an exploded view. The pin knuckle 11 is shown with a base member 14 which includes a mounting portion 15. The mounting portion 15 includes mounting means, such as, for example, one or more bores 16, for facilitating mounting of the base member 14 to a panel, such as a door, or a cabinet or doorway. The pin knuckle 11 has a body portion 17 and is shown with an associated pin member 12. Connecting means is provided to connect the pin member 12 to the pin knuckle 11. The pin connecting means is preferably provided as an adjustable means, which is shown comprising a series of threads 18 disposed on the outer peripheral surface of the pin member 12. The pin member 12 also includes a pivot portion 19 which is provided to extend outwardly from the pin knuckle body portion 17 and be received in the pivot bore 56 (FIG. 6) of the pivot knuckle 13. The connecting means further comprises a pin retaining member 21 which is received in an enlarged portion 57 of the bore 56 disposed in the body portion 66 of the pivot knuckle 13.

Figure 3:
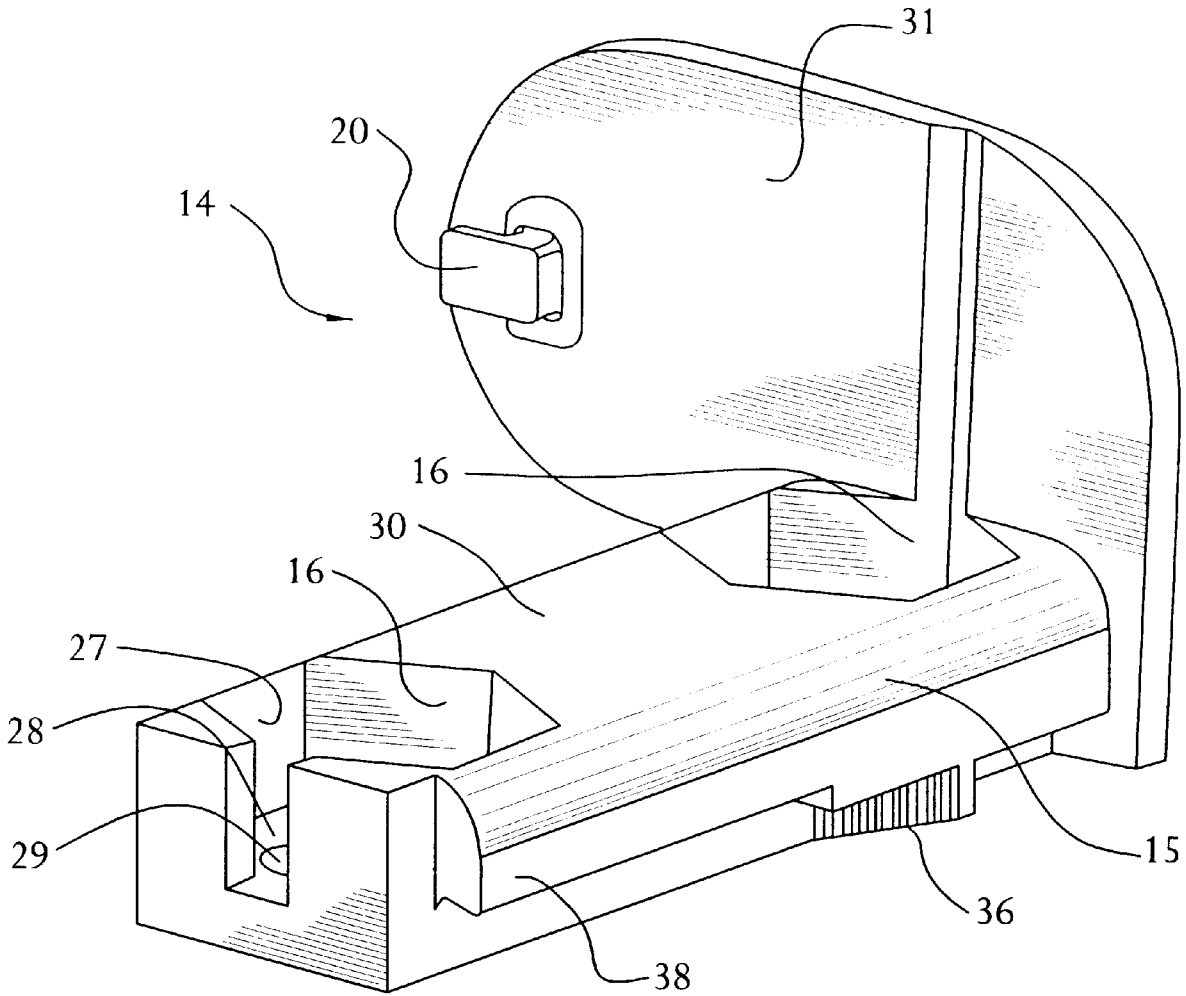
FIG. 3 is a left side, parallel perspective view of the pin knuckle base member of the hinge assembly of FIG. 1.

Referring to FIG. 3, the base member 14 is shown having mounting bores 16 disposed therein. While not shown, fastening members, such as, for example, bolts, screws, and the like, can be utilized to attach the base member 14 to a panel. Preferably, the mounting bores 16 can comprise a hexagonally configured recess 27 and a shelf portion 28 on which the head of a fastening member, while not shown, can be seated. An aperture 29 is provided in each mounting bore through which the shaft of a fastening member, not shown, can pass to eventually be fastened to a panel. The recessed configuration permits the fastening member to reside below the upper surface 30 of the base member 14. The base member 14 has an end plate 31, which as shown in FIG. 1, seals the interior of the pin knuckle assembly 11 from dirt and debris entry therein. A clamping tab 20 is provided to facilitate securing of the pin knuckle 11 onto the base member 14. The tab 20 is shown in a preferred configuration as a generally L-shaped member, and can snap over a receiving boss (not shown) provided on the pin knuckle 11 to retain the components together. While shown as a hexagonal recess, it will be understood that other recess configurations can be provided. For example, a standard round recess to retain the head of a screw, rivet or other fastening member can be employed. Mounting of the base member 14 can be therefore achieved from the front or rear of the panel to which the base member 14 is to be mounted. Additionally, while not shown, hex bolts can be used for fastening the base member 14 to a panel or other hinging member from the rear of the panel or member.

Figure 4:
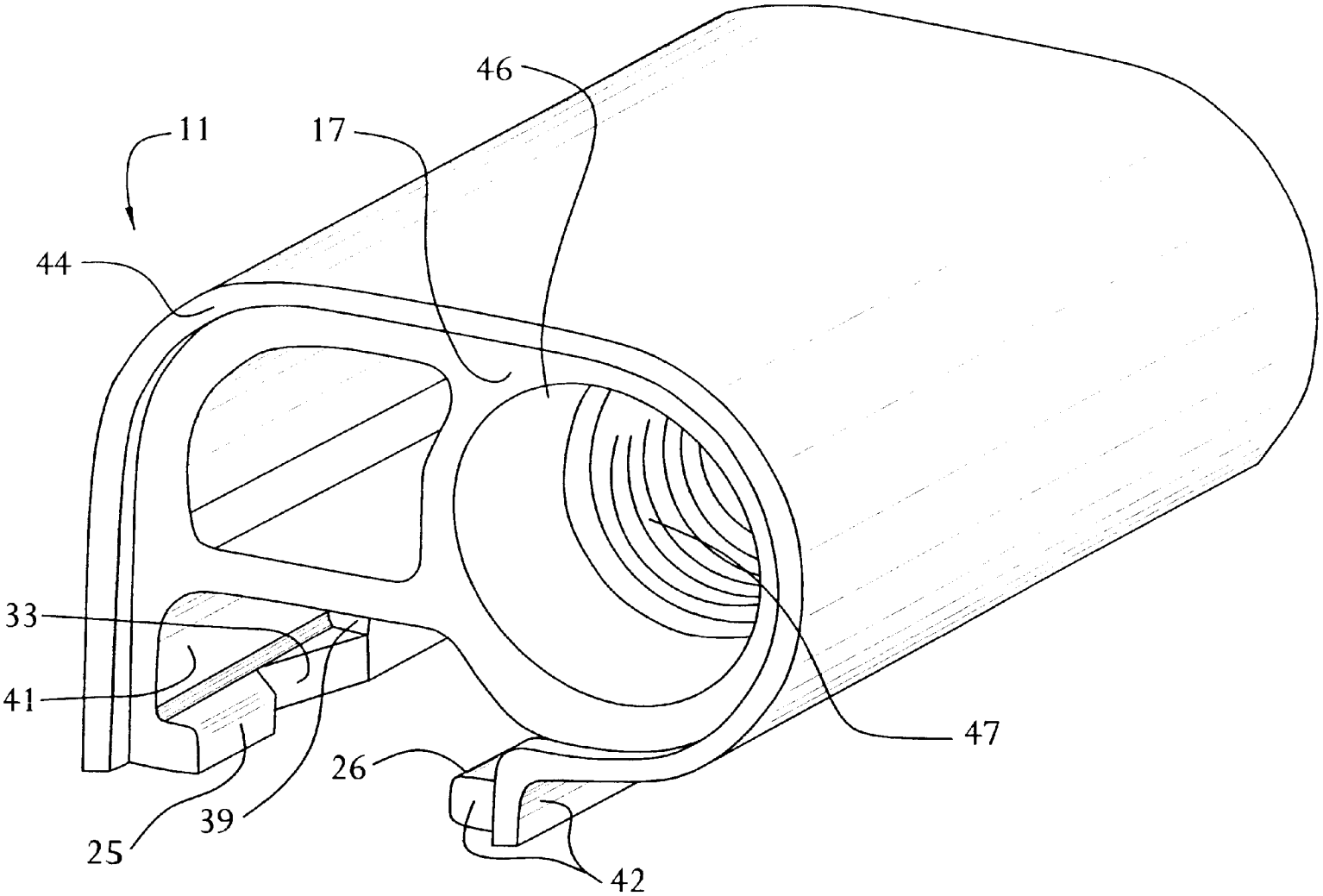
FIG. 4 is a left side, parallel perspective view of the pin knuckle shown in FIG. 1.
Figure 5:
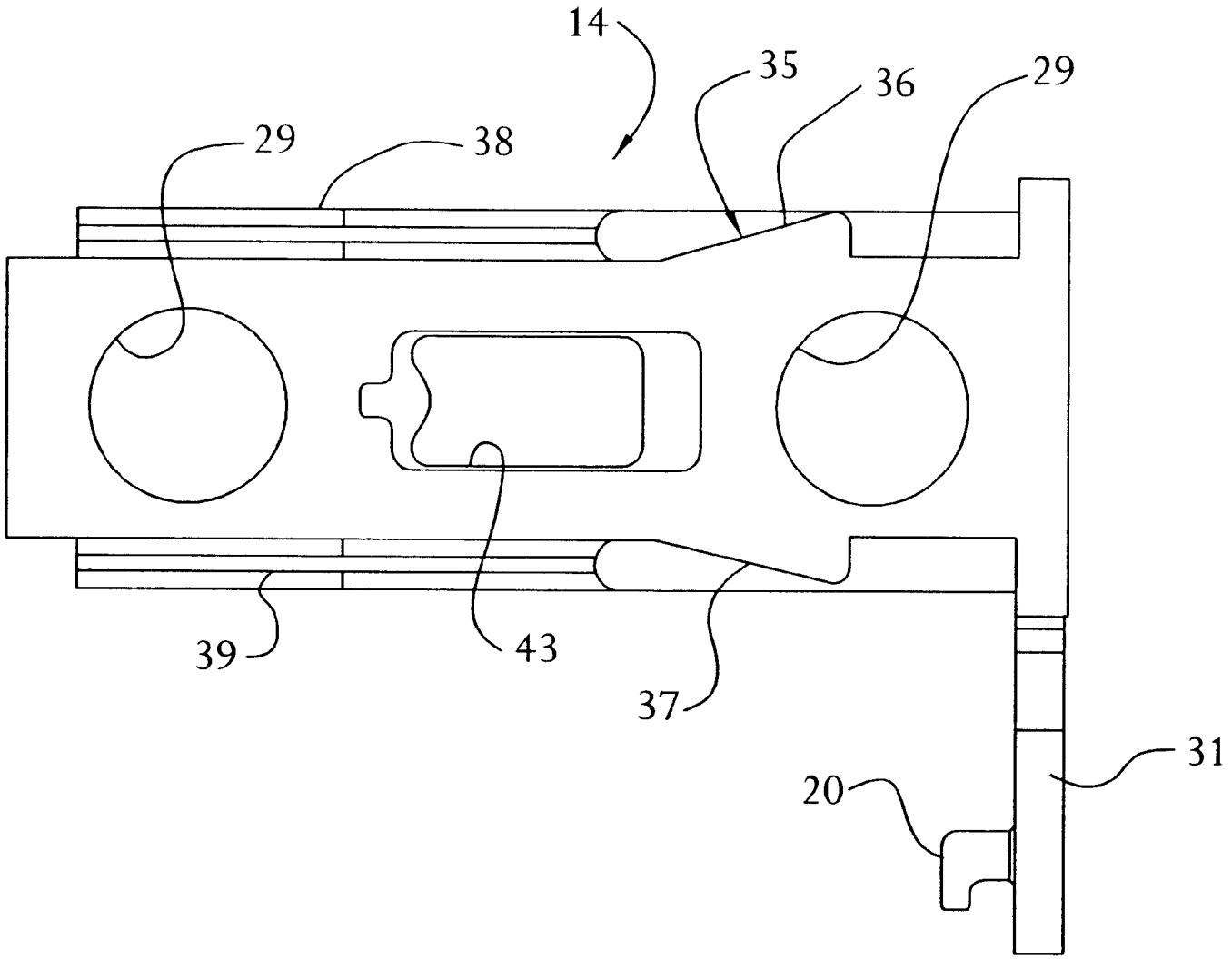
FIG. 5 is a bottom plan view of the base member shown in FIGS. 2–3.

Referring to FIG. 5, connecting means is provided on the base member 14. The connecting means is shown, preferably, including a retaining element comprising the dovetail 35. The dovetail 35 has a pair of retaining wings 36, 37 which protrude outwardly on each side of the base member 14. Preferably, the connecting means further includes a pair of guide flanges 38,39 provided to facilitate coupling of the base member 14 with the pin knuckle body 17. The pin knuckle member 11 is provided with matingly associated coupling means to secure the base member 14 thereto. Referring to FIG. 4, coupling means is provided on the pin knuckle member 11 to receive the mounting portion 15 of the base member 14. Preferably, the coupling means comprises track means including a pair of tracks 25,26 for facilitating seating of the pin knuckle 11 on the mounting portion 15 of the base member 14. The tracks 25,26 each includes a notched recess, respectively, 33,34 which receives the dovetail wings 36,37, respectively, of the base member 14.

In a preferred installation, the base member 14 is mounted to a door, panel or other mounting surface. The pin knuckle 11 can then be installed to the base member 14 by sliding. The tracks 25,26 are slidably moved along the guide flanges 38,39 of the base member 14. The dovetail 35 preferably is installed by sliding and snapping the pin knuckle member 11 along the base 14 to force the wings 36,37 into position within the respective retaining notches 33,34. Preferably, snap-fit installation is facilitated by providing a pair of spring wall portions 41,42 on the pin knuckle member 11 as shown in FIG. 4. These wall portions provide flexibility to permit the dovetail wings 36,37 to be received within the respective retaining notches 33,34 of the pin knuckle 11. Preferably, a positioning tab 39 is provided on the pin knuckle body 45 to further facilitate the positioning of the pin knuckle 11 on the base member 14. For example, while not shown, the base member 14 can have a receiving slot or notched portion to accommodate the positioning tab 39. In addition, the end plate 31 can be provided with connecting means to secure the connection between the base member 14 and the pin-knuckle 11. For example, while not shown, the connecting means can comprise a mating ridge and groove configuration provided in the base member 14 and the pin knuckle 11, or other suitable retention elements.

Locating means is provided to facilitate location of the hinge components on a panel or other member during installation. Preferably, the locating means further comprises orientation means for facilitating the proper orientation of a hinge component of the present invention, such as, for example, the base member 14, which is to be installed on a panel. The locating and orientation means facilitates installation of the base member 14 in the appropriate position relative to the pin knuckle, carrying member, or pivot knuckle which is to be connected to the base. The locating means is shown in FIG. 5 comprising a positioning bore or orientation core configuration 43. Preferably, while not shown, a panel can include or be provided with a matingly associated element, (which can, for example, include a boss or detent), which can be received in the positioning bore 43 of the base member 14. This enables the base 14 to be aligned for proper location of the hinge assembly for installation at a particular position on a panel.

Figure 7:
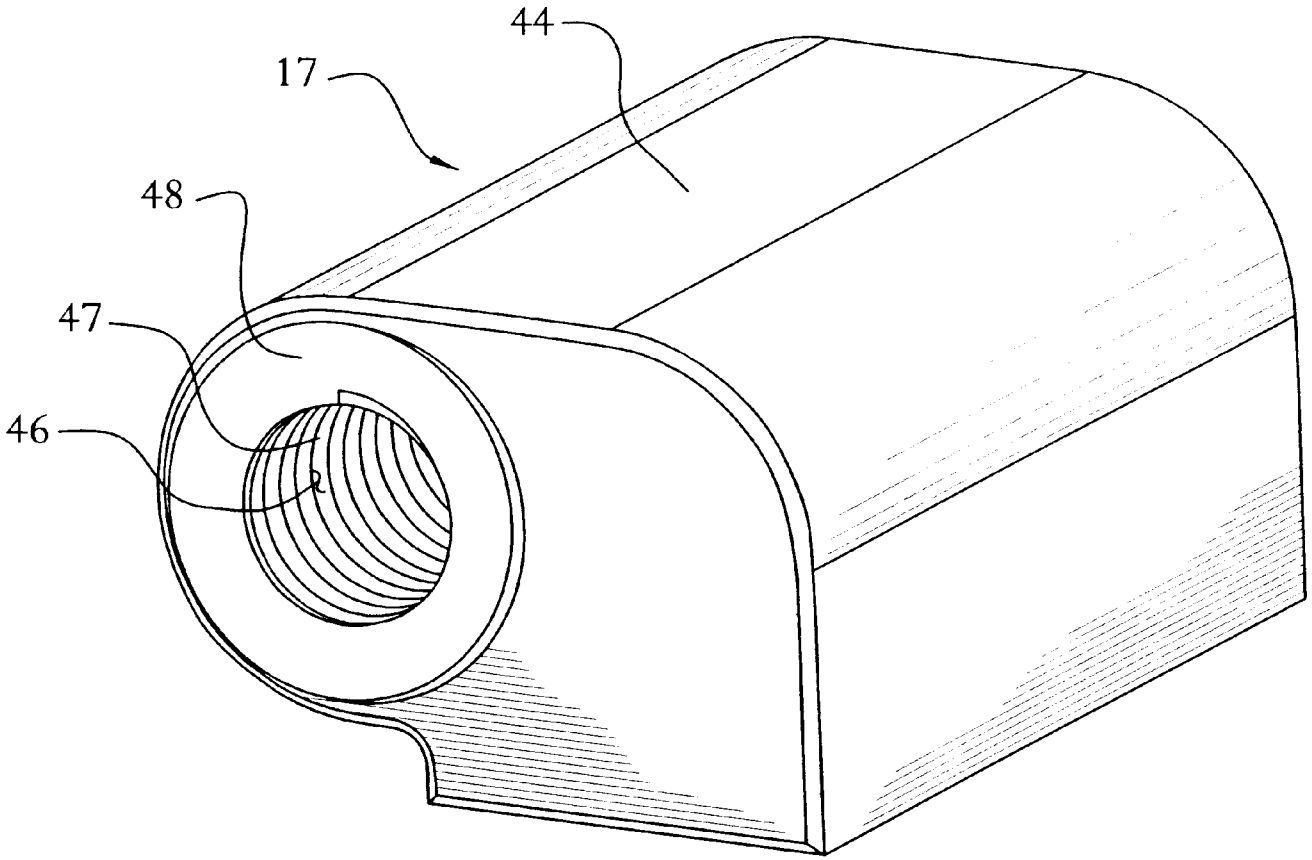
FIG. 7 is a right side, parallel perspective view of the pin knuckle shown in FIGS. 1, 2 and 4.

The pin knuckle 11 of the hinge assembly 10 is shown with a housing 44 in FIGS. 1, 2, 4 and 7, which partially surrounds the pin knuckle body 17. Preferably, the housing 44 comprises a flexible material to provide a member which can be installed on the pin knuckle 11 by snap-fitting. However, it is also conceivable that the housing 44 can be attached to the pin knuckle body 17 by sliding. Further, it will be understood that the housing can be provided integral with the pin knuckle body 17. In FIG. 4, the pin knuckle body portion 17 is shown having pin-retaining bore 46 therein. While a pin member can be fixedly mounted within the pin knuckle 11, preferably, an adjustable pin-connecting means is provided to permit installation of the pin member 12 to the pin knuckle 11. The pin-connecting means is shown in FIG. 4 comprising threads 47 which are matingly provided to receive the threaded portion 18 of the pin 12. The threads 47 of the pin-retaining bore 46 extend through the pin knuckle body 17 and terminate at the opposite end of the bore 46 (FIG. 7). Pin adjustment means is provided to regulate the extension of the pin 12 from the pin knuckle 11. Preferably, the pin adjustment means comprises the mounting member 21 which is matingly threaded in relation to the pin threaded portion 18. The pin threaded portion 18 can be screwed into the matingly provided threaded bore 46 to protrude from the pin knuckle 11 over a range of positions. The mounting member 21 facilitates the retention of the pin 12 to the pin knuckle 11 at a particular extended length of the range available. As shown in FIG. 7, a retaining shoulder 48 is provided at the end of the bore 46 against which the retaining member 21 can be tightened to secure the pin 13 therein. The retaining shoulder 48 provides clearance between the pin knuckle 11 and pivot knuckle 13 components.

Figure 6:
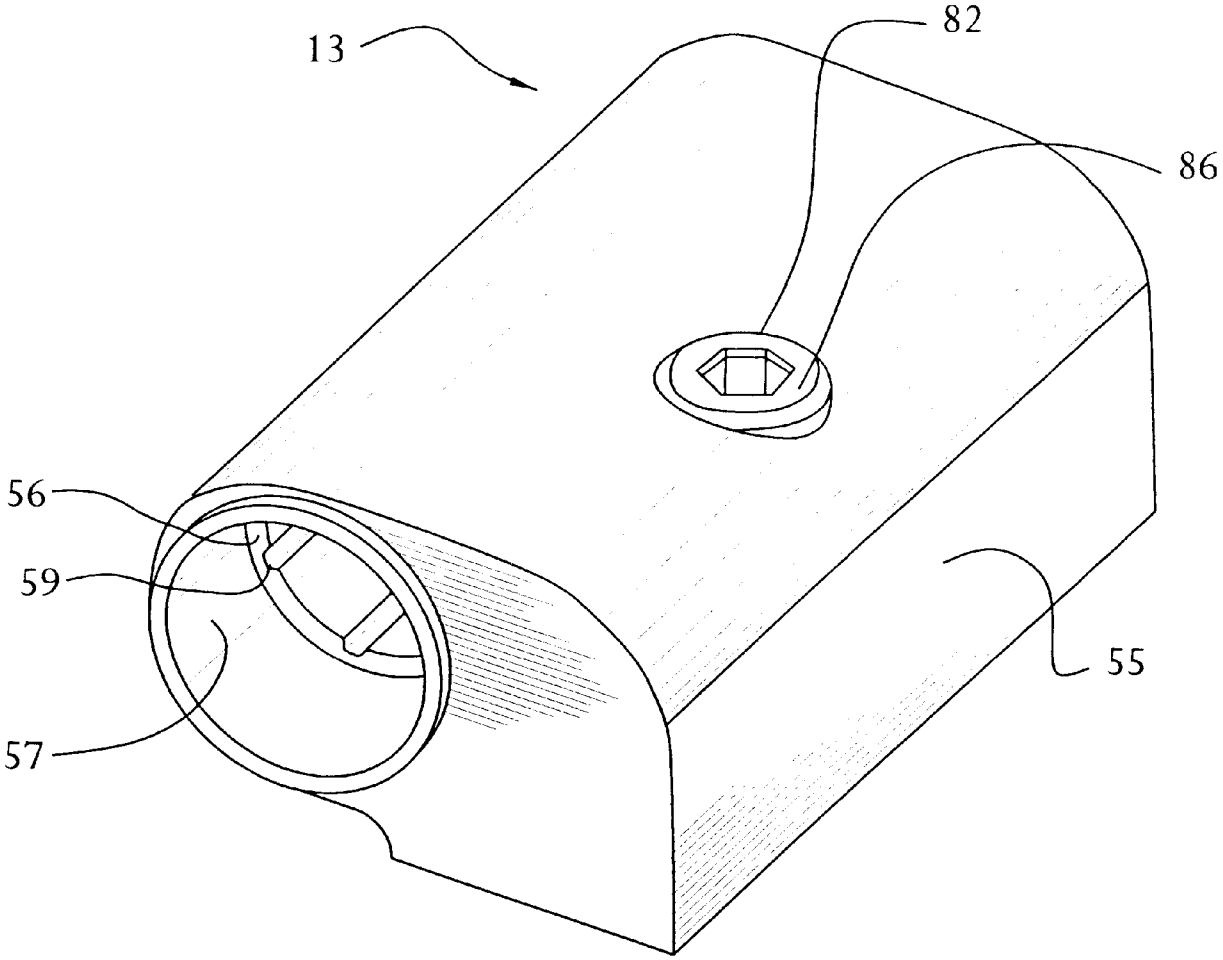
FIG. 6 is a left side, parallel perspective view of the pivot knuckle shown in FIG. 1.

Referring to FIG. 6, the pivot knuckle 13 is provided having a housing 55 and pin-receiving means such as, for example, the pin-receiving bore 56, which receives the pin member 12 of the pin-knuckle 11. A pin mounting member recess 57 is provided at the opening of the pin-receiving bore 56 to accommodate the mounting member 21 when the hinge assembly is installed on a door and panel. The recess 57 provides clearance for the mounting member 21.

Figure 14:
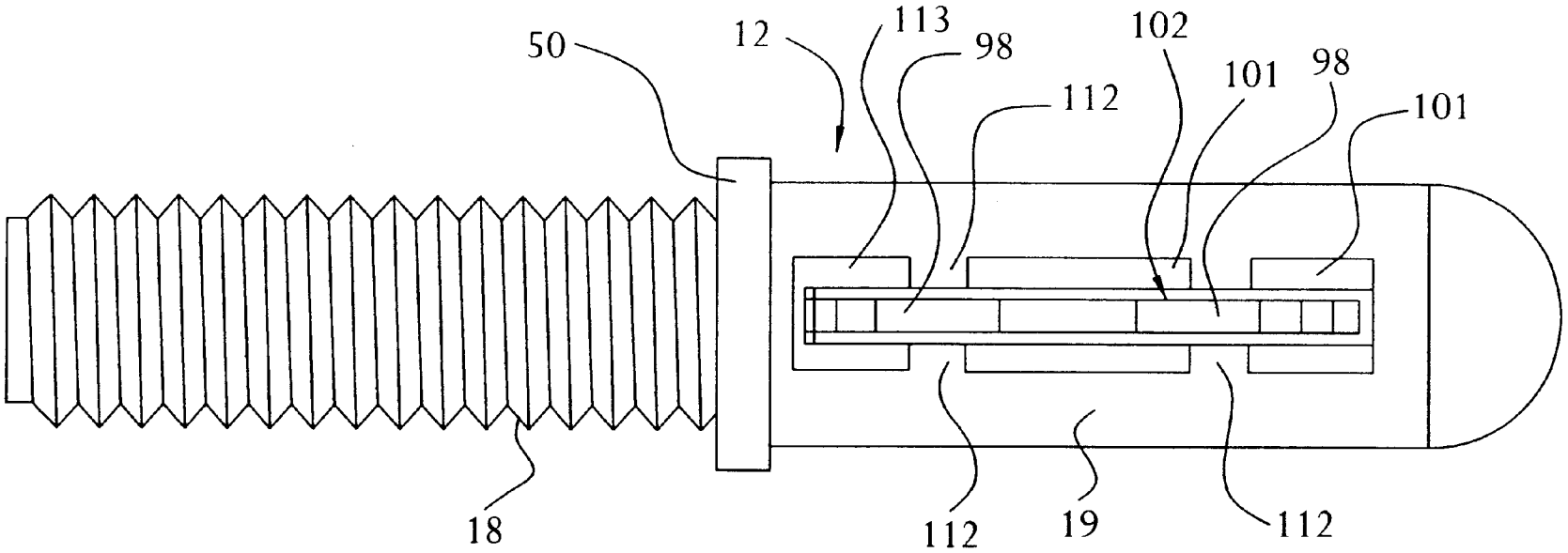
FIG. 14 is an enlarged top plan view of the pin member shown in FIG. 2.

Force handling means are provided on the pin 12 to facilitate distribution of a force load. Referring to FIG. 14, the force handling means is shown comprising a shoulder 50 which is provided to sit on the rim 59 of the pivot knuckle receiving bore 56 when the pin 12 is installed.

Figure 8:
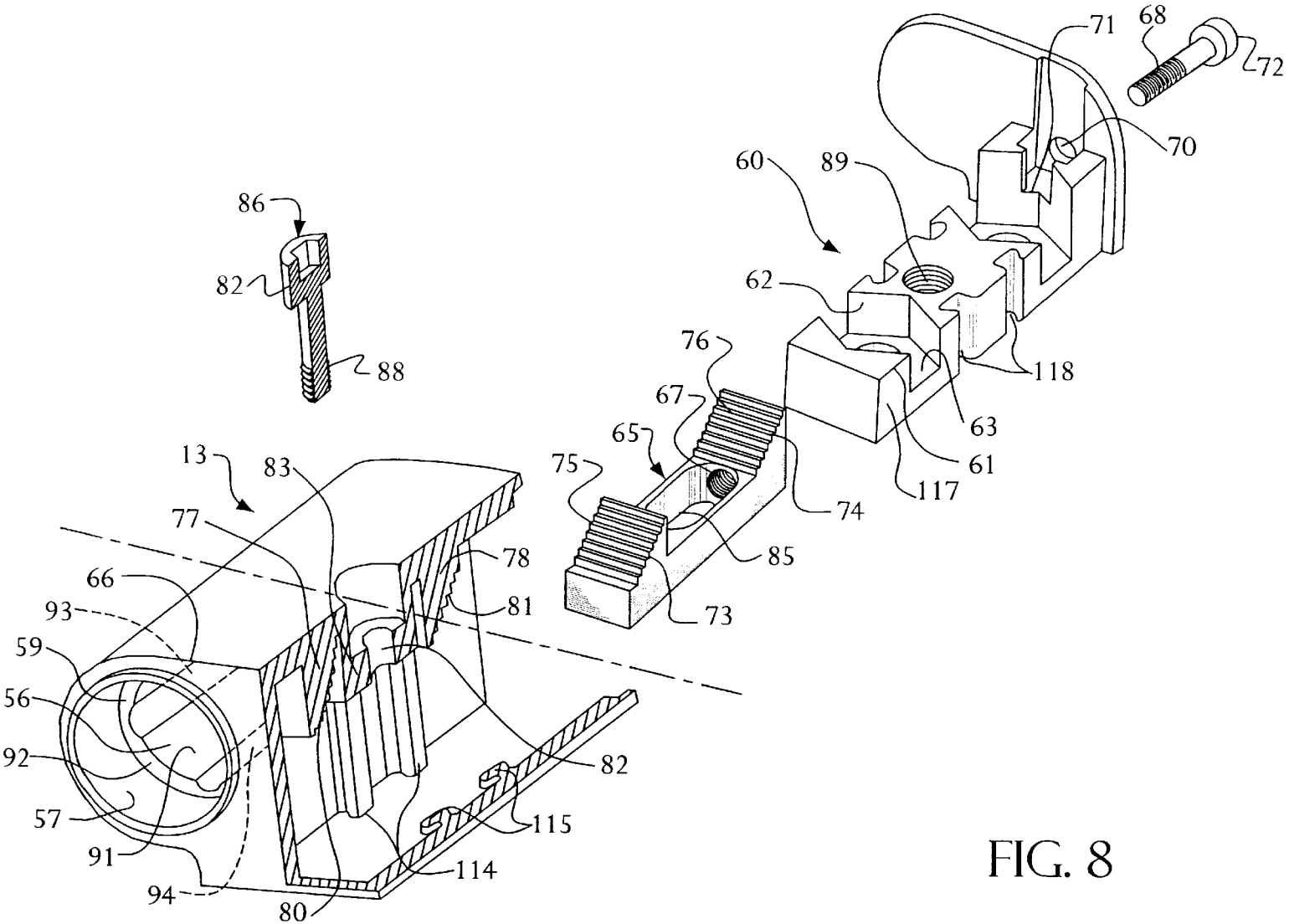
FIG. 8 is a left side, exploded, parallel perspective view of the pivot knuckle assembly of the hinge assembly of FIG. 1 shown with an adjustable base member.
Figure 9:
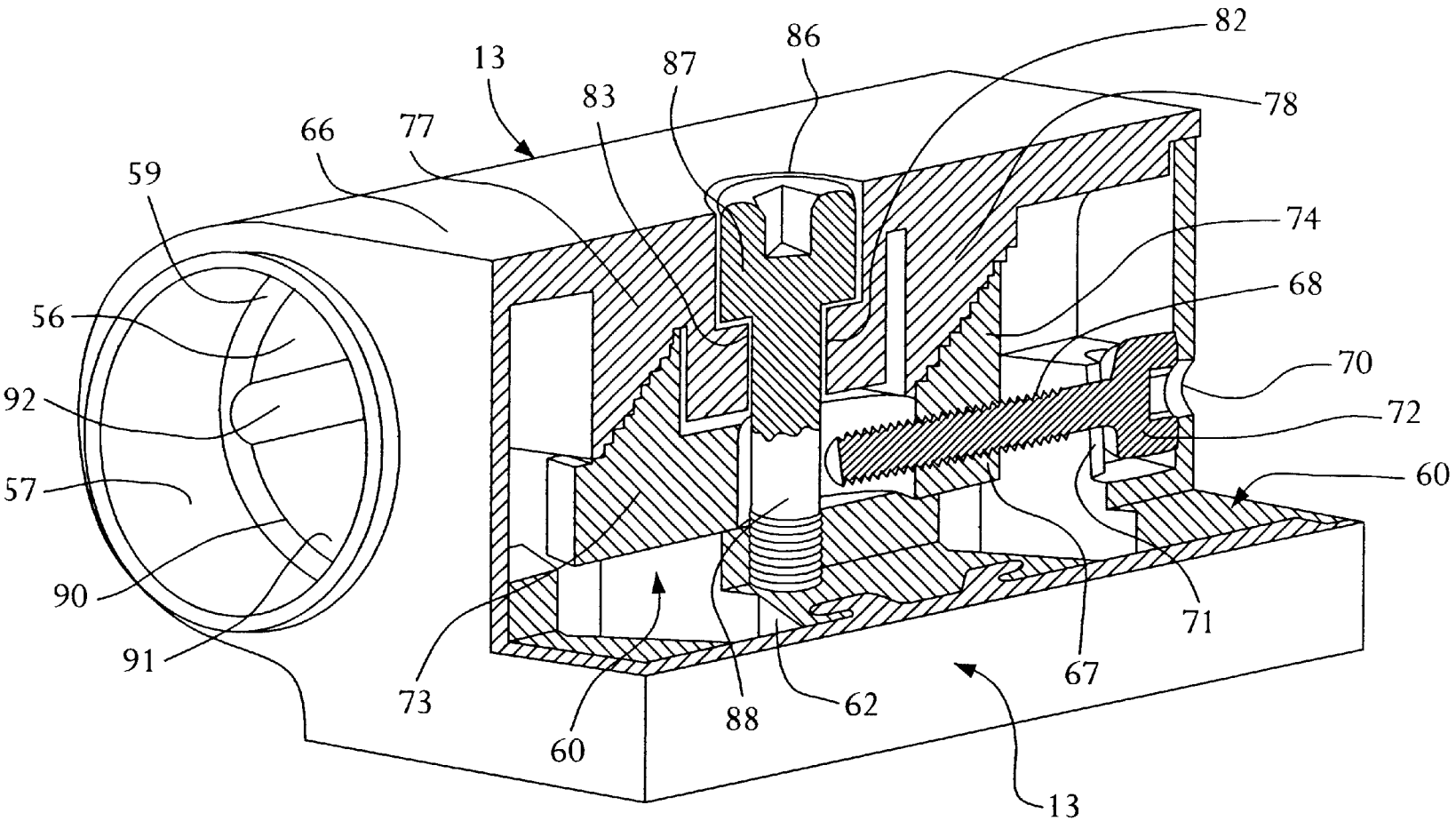
FIG. 9 is a longitudinal, partial-sectional, parallel perspective view of the pivot knuckle assembly and adjustable base member of FIG. 8 shown in an assembled condition.
Figure 10:
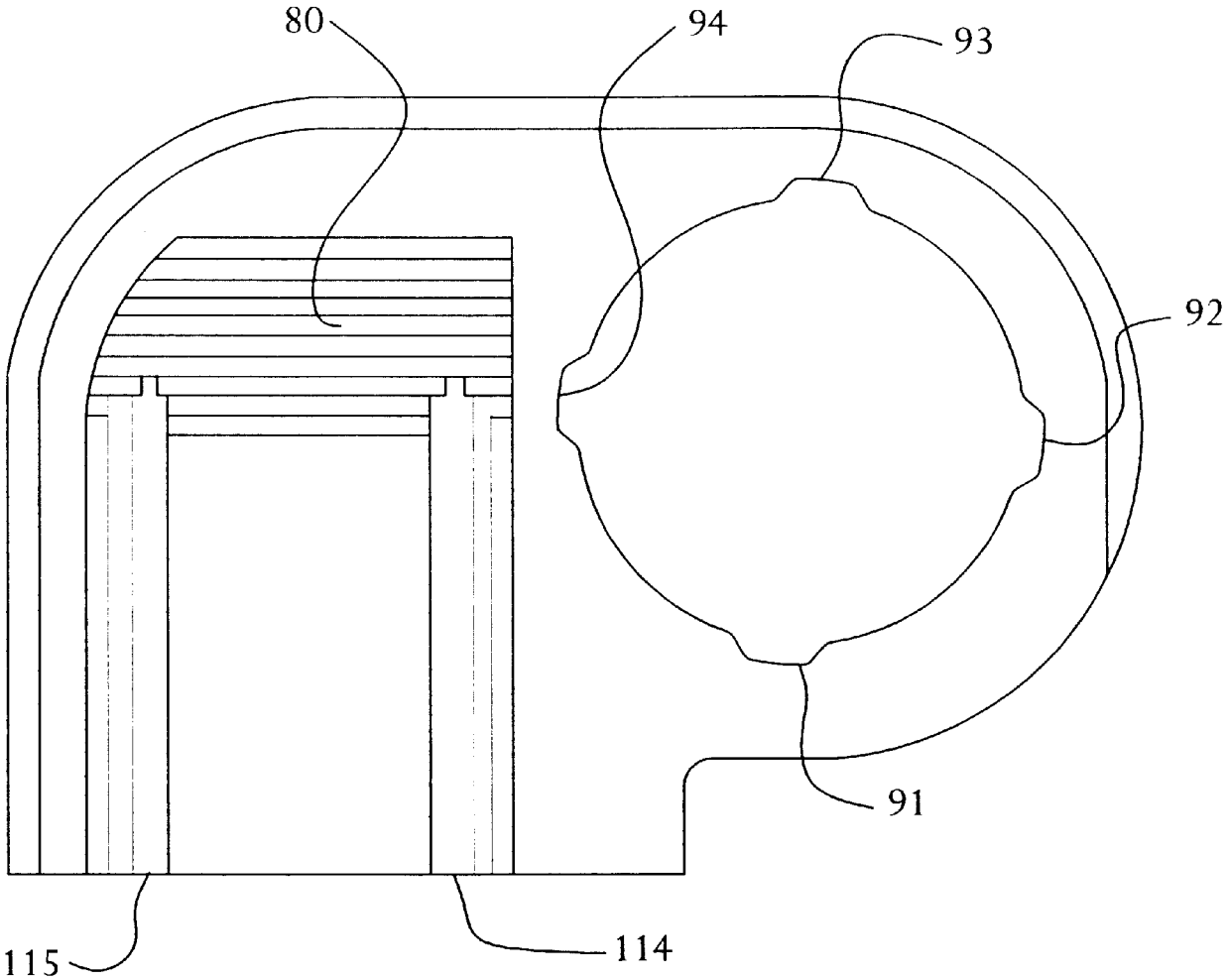
FIG. 10 is a right side elevation view of the pivot knuckle of FIG. 8.

Referring to FIG. 8, the pivot knuckle mounting base 60 is shown with components of the pivot knuckle 13 in an exploded view. The pivot knuckle mounting base 60 includes mounting means such as those described above in relation to the pin knuckle mounting base 14. For example, the mounting bores 61 are provided, and can have the hexagonally configured recess 62 and shelf 63 for receipt of a mounting member, such as, for example, a fastening member, not shown. However, the pivot knuckle mounting base 60 is configured for adjustability of the pivot member which it mounts. Pivot adjustment means is provided to facilitate alignment of the pivot knuckle 13 with respect to the door or panel on which it is installed. The pivot adjustment means further can regulate the positioning of the pivot knuckle 13 relative to the pin 12. Preferably, the pivot knuckle adjustment means includes a positioning member 65 which aligns the pivot knuckle body element 66 relative to the base member 60. The positioning member 65 includes a first bore 67 which is preferably threaded to receive the vertical adjustment screw 68. The base member 60 is provided with an aperture 70 through which to access the vertical adjustment screw 68. A seat 71 is provided in the base member 60 which defines an area within which the head 72 of the adjustment screw 68 resides. As shown in FIG. 9, the vertical adjustment screw 68 is received in the first bore 67 of the positioning member 65. The positioning member 65 includes engaging means for engaging the pivot knuckle body element 66. The engaging means is shown in a preferred wedge configuration comprising the wedge portions 73,74. The wedge portions 73,74 are provided with stop means to control the positioning of the positioning member 65 within the pivot knuckle assembly. In a preferred embodiment, the stop means are shown comprising a series of ridges 75,76 disposed on the engaging surfaces of the wedge portions 73,74, respectively. The pivot knuckle body element 66 is provided with flanges 77,78 extending inwardly into the body. Each flange 77,78 is provided with stop means, shown comprising a series of stepped ridges 80,81, which are matingly associated with the positioning member ridges 75,76, respectively. The positioning member stop means is provided to facilitate alignment of the pivot knuckle 13 with respect to one or more other hinge elements and the hinge panel members on which the assembly 10 is to be installed.

Figure 13:
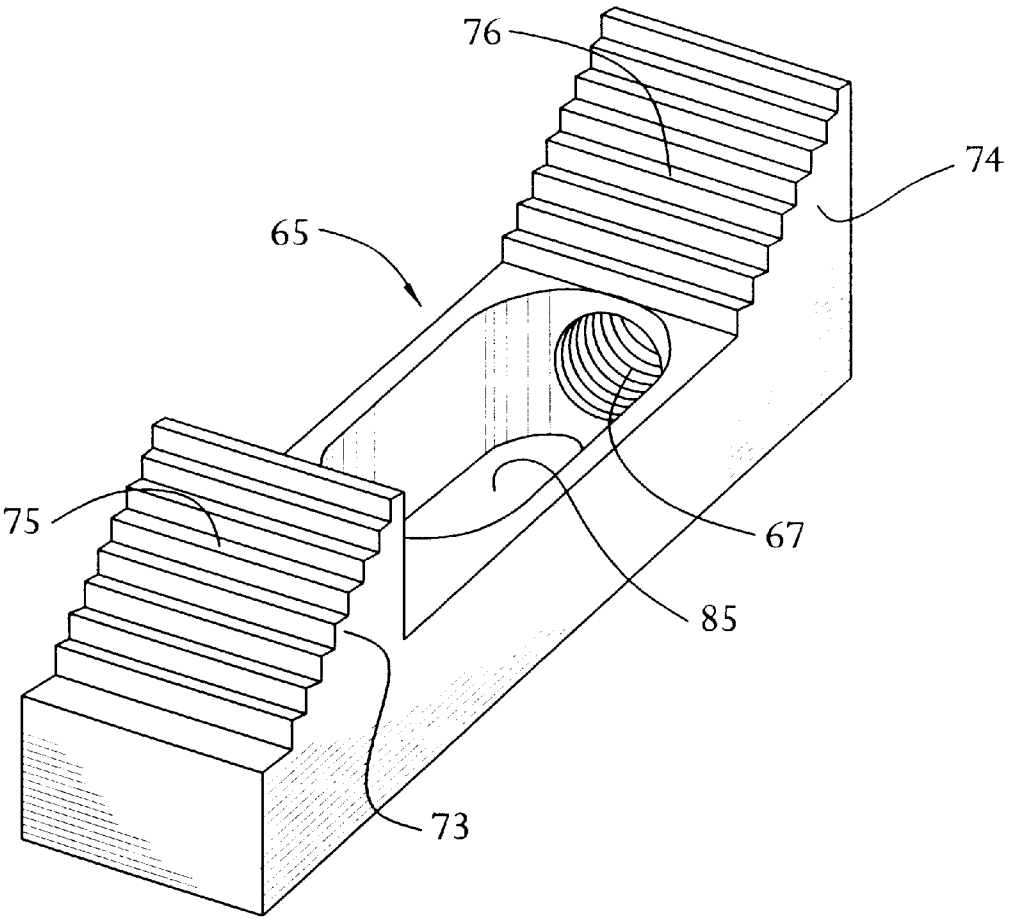
FIG. 13 is a left side, parallel perspective view of the positioning member shown in FIGS. 8 and 9.

As mentioned above, as shown in FIGS. 8 and 9, the positioning member 65 can also be adjusted in the longitudinal direction with respect to the pivot knuckle 13, with the vertical adjustment screw 68. Preferably, in addition to the vertical or longitudinal adjustment feature, the alignment means further can provide the pivot knuckle 13 with a lateral adjustment capability. The pivot knuckle body 66 includes a bore 82 disposed therein and having a seat 83. Preferably, the bore 82 is provided on a location of the pivot knuckle body 66 which can be accessed when the hinge assembly 10 is installed on a door, or other hinging member. The positioning member 65 is shown having a second bore 85 disposed therein, as is shown in the dotted-line outline in FIG. 8, and in the top view of FIG. 13.

Referring again to FIG. 8, a clamping screw 86 is provided having a head 87 and a threaded portion 88. A threaded bore 89 is provided in the base member 60 to receive the threaded portion 88 of the clamping screw 86 therein. The clamping screw 86 regulates the level of the positioning member 65 in the direction relative to the clamping screw 86 axis. This facilitates adjustment of a hinging member in a perpendicular direction relative to the door or panel to which the pivot knuckle 13 is mounted, or laterally in relation to the door or panel. The adjustment means provides a plurality of positions for aligning the pivot knuckle body 66 relative to the base member 60. For example, if the door or panel, by itself does not adequately align with the pin 12, then the adjustment means can be utilized to maneuver the pivot knuckle 13 to improve the connection with the pin 12. Alignment is facilitated by the vertical and lateral adjustment capabilities.

Figure 15:
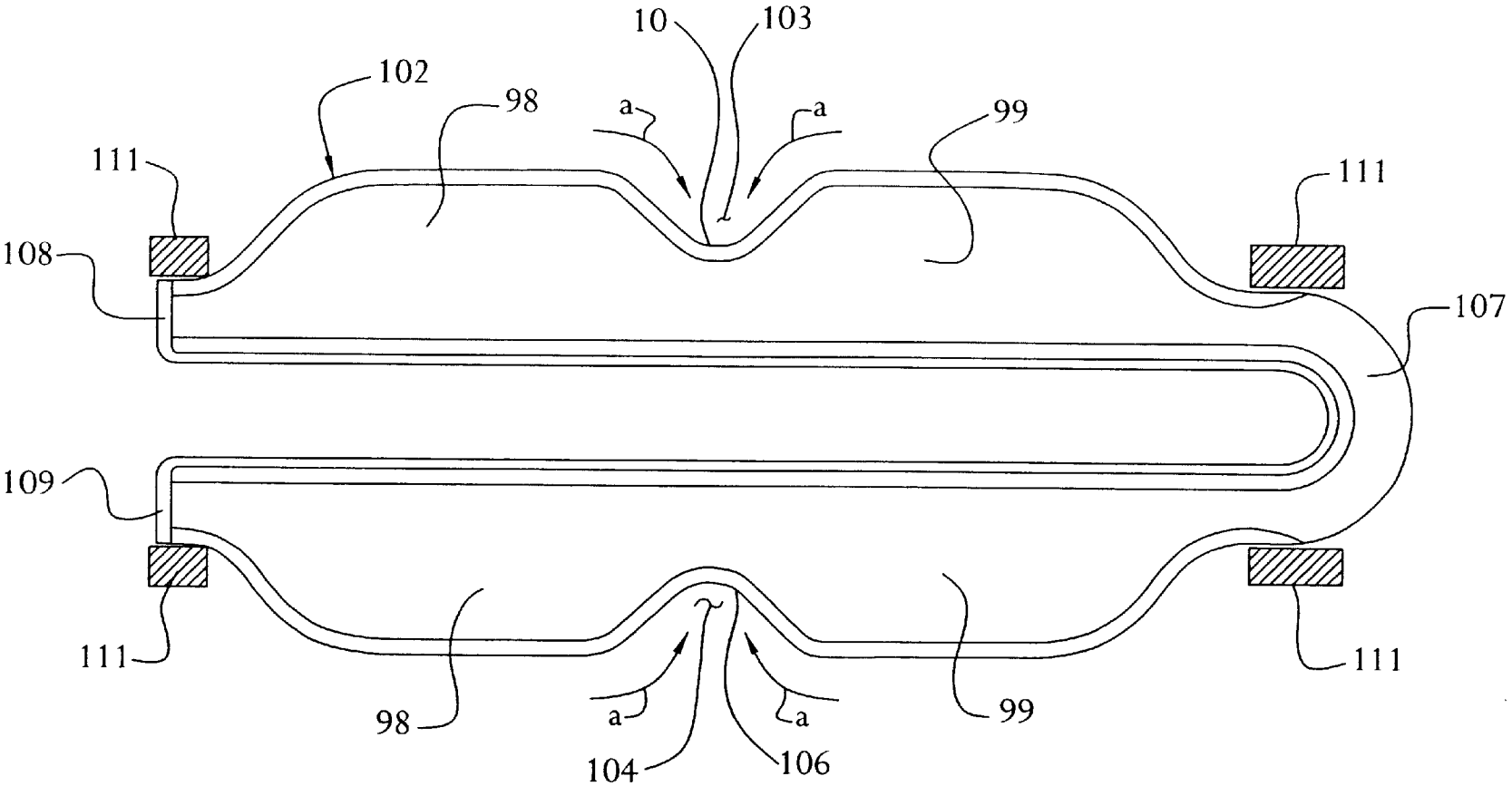
FIG. 15 is a front elevation view of the flexible member of the pin shown in FIGS. 2 and 14.

As shown in FIGS. 6, and 8–10, a plurality of locating detents 91,92,93,94 are provided longitudinally on the inner circumferential portion of the pin-receiving bore 56 and are circumferentially spaced apart. Referring once again to FIG. 2, the pin 12 is provided with pawl means shown, for example, comprising protruding vanes 98,99 extending outwardly from the pivot portion 19 of the pin 12. Preferably, the protruding vanes 98,99 are resiliently provided to accommodate a force load directed axially toward the central axis of the pin 12. When the protruding vanes 98,99 receive a force load, they recede against their biasing force, into the pawl holding space 101 (FIG. 14). The force load is generally provided by the inner wall of the receiving bore 56. The protruding vanes 98,99 return to their raised position (the FIG. 2 position) upon being rotated to align with one of the plurality of locating detents 91,92,93,94 on the longitudinal receiving bore 56. As shown in FIG. 15, the vanes 98,99 are provided as components of a flexible member 102 which includes a flex accommodation zone 103, 104 between each of the vanes 98,99 proximate to the valleys 105,106 located between vane pairs 98 and 99. The arrows "a" indicate the flex direction. Retaining means are also provided to hold the flexible member 102 within the pivot portion 19 of the pin 12. Preferably, as shown in FIG. 15, the joined end 107 and the legs 108,109 of the flexible member 102 are held in place within the pivot portion 19 of the pin 12, or preferably can be retained with holding members, generally 111, which can be disposed within the pin 12 to secure the flexible member 102 in place therein. The flexible member 102 is further supported by the pin 12 against lateral displacements with support means. The support means are shown comprising fingers 112 which extend along opposite edges of the slot 113 of the pin 12 through which the flexible member 102 extends. Referring to FIG. 14, although shown only on one side of the pin 12, the flexible pawl member 102 preferably includes a similar configuration on the bottom of the pin 12, as that described in FIG. 15. The flexible member 102, while shown as a separately provided element, can alternately be provided integral with the pin 12.

A further advantage of the pin 12 includes the ability to adjust the pin stops provided by the detents 91,92,93,94. For example, the pin 12 can be installed or positioned to align the vanes 98,99 of the pawl 102 to engage one or more of the detents 91,92,93,94 with the door or first hinge panel member maintained at a specific angle or opening, relative to the doorframe or second hinge panel member.

Figure 11:
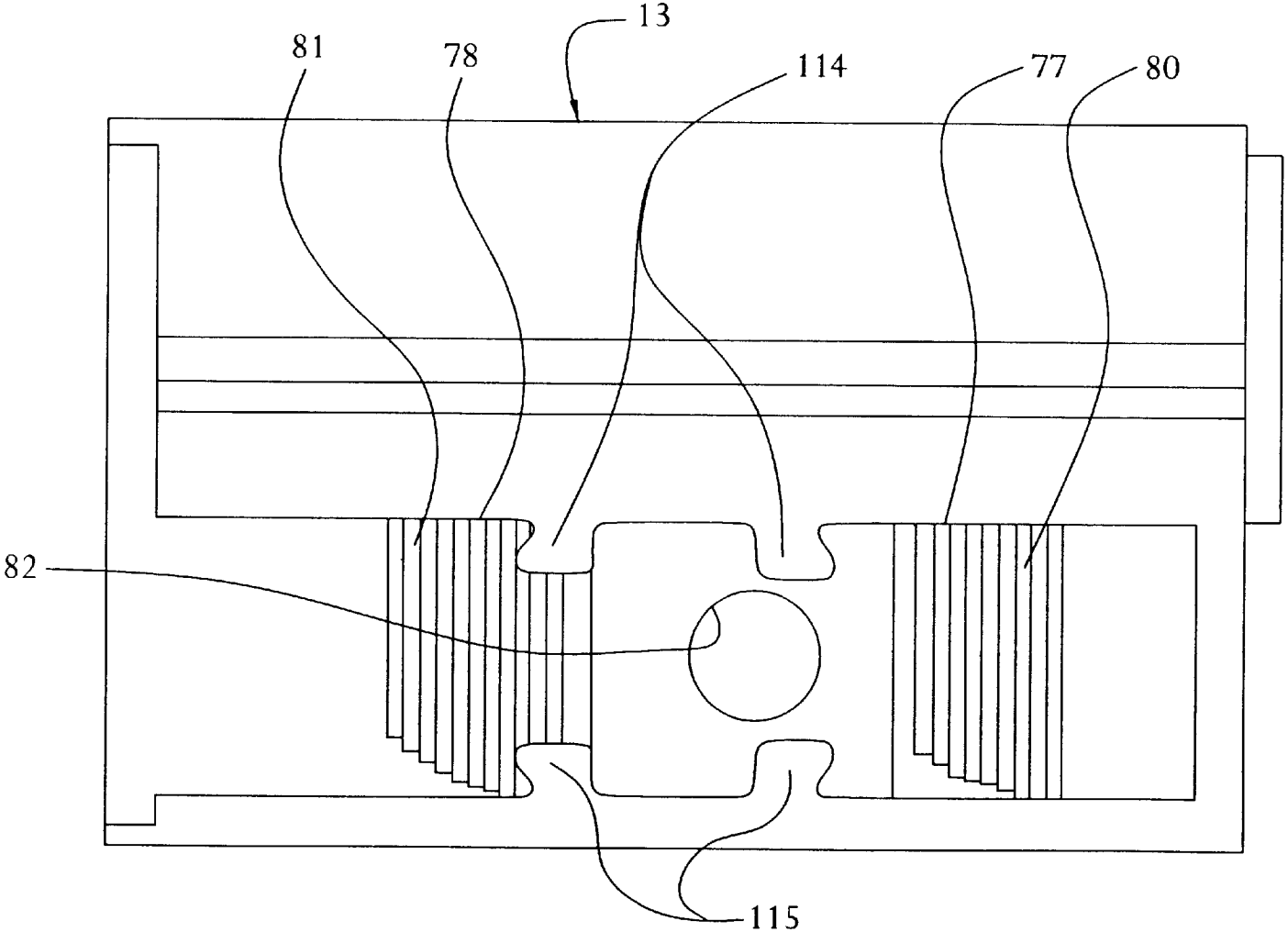
FIG. 11 is a bottom plan view of the pivot knuckle shown in FIGS. 1,6, and 8–10.
Figure 12:
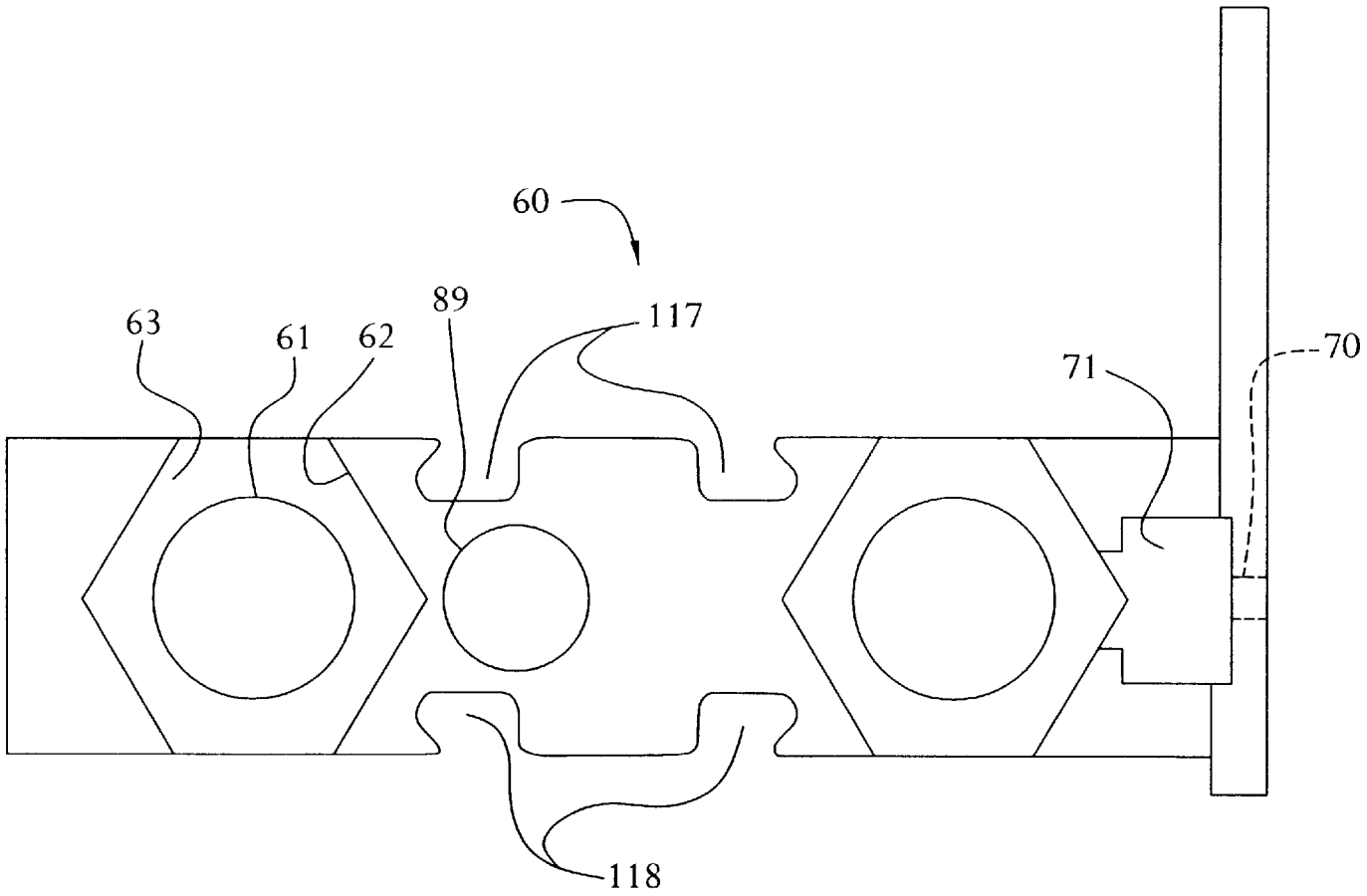
FIG. 12 is a top plan view of the adjustable base member shown in FIGS. 8 and 9.

Referring to FIGS. 8, 11 and 12, preferably, in addition to the clamping screw 86 utilized to secure the pivot knuckle 13 to the pivot knuckle base 60, supporting connecting means are provided for maintaining the pivot knuckle 13 on the base member 60. Preferably, the supporting connecting means can comprise dovetail means. The supporting connecting means are shown comprising dovetail means including a first pair of interfitting legs 114 and a second pair of interfitting legs 115 disposed on the pivot knuckle 13. The dovetail means further comprises matingly associated leg recesses 117,118 disposed in the adjustable pivot knuckle base 60 which receive, respectively, the legs 114,115 of the pivot knuckle 13.

In addition to those mentioned above, it will be further understood that alternate pawl embodiments can be utilized consistent with the principals of the present invention. For example, while not shown, the pawl member can comprise vanes which are provided with a separately furnished spring for enabling the vanes to retract within the pin and extend therefrom. Furthermore, the vanes may also be torsionally controlled, wherein they are retracted and extended in conjunction with the rotation of the pin 12. A further alternate embodiment, includes providing integral vanes on the pin pivot portion 19 which can be moved into and out of the longitudinal channels disposed on the bore of the pivot knuckle 13.

Referring to FIG. 16, an alternate pin embodiment is shown, wherein a pin member 120 is provided having a pivot portion 119 and a torsionally configured vane member 121 including a vane stem 122 connected to a resilient vane base 123 which forms a portion of the circumference of the pin pivot portion 119, as shown in the cross-sectional views of FIGS. 16*a* and 16*b*. While not shown, it will be understood that stiffening ribs can be longitudinally disposed along the length of the vane 122 on the portion thereof disposed between the circumference of the pivot portion 119. The pin 120 preferably can be utilized with the pin knuckle 11 and pivot knuckle 13, as described above. As shown in FIGS. 16*a* and 16*b*, the vane 123 is received in a locating detent 124 provided on a pin-receiving bore 125, such as the detents 91,92,93,94 and bore 56 described above. Although one vane 120 is shown, it is conceivable that if desired, a plurality of vanes can be used. In addition, a plurality of detents can also be provided along the bore. When the bore 125 is rotated relative to the pin 120, as shown for example by the movement indicated in the direction of arrow "b," from the FIG. 16*a* to the FIG. 16*b* position, the vane 122 moves out of the detent 124 and collapses to permit relative rotation of the pin 120 with respect to the bore 125. The collapsing movement of the vane 122 is torsional as shown by arrow "c."

Referring to FIG. 17, an alternate embodiment of a pin member 130 in accordance with the present invention is shown including a threaded mounting portion 131 and a pivot portion 132. The pin member 130 has a slot therein 134 for receiving an insert member 133. Preferably, a spring member 135 is provided for receipt within the insert member 133. The spring member 135 preferably is comprised of a resilient material, such as, for example, urethane, rubber or other elastomers. Vanes 136,137 provided on the insert member 133 can be utilized, as described above, in association with longitudinal detents in the pin-receiving bore of the pivot knuckle. A collar 138 is also provided on the pin member 130 to operate as described herein with respect to force distribution. It will be understood that alternate configurations of the insert member can be employed with the present invention. For example, the spring element 135, while shown as a separately provided member, can be integrally provide with the insert member.

Reference now being made to FIG. 18, an alternate embodiment of a hinge assembly 150 according to the present invention is shown in an exploded view. The hinge assembly 150 comprises a pin knuckle 151 and a base member 152 having a mounting portion 153 thereon for connection to the pin knuckle 151. The mounting portion 153 includes apertures 154, 155 for facilitating mounting of the base member 152 to a panel, such as a door, cabinet, doorway, or the like. The pin knuckle 151 has a pin 158 extending therefrom. The pin 158 can be fixedly mounted to the pin knuckle 151, or may be adjustably provided, as described above in relation to the threaded pin 12. Connecting means is also provided on the pin knuckle member 151 to receive the mounting portion 153 of the base member 152. Preferably, the connecting means can comprise track means 160 having a pair of tracks 161, 162 for facilitating seating of the pin knuckle 151 on the mounting portion 153 of the base member 152. As shown in FIG. 19, the connecting means provided on the base member 152 preferably, additionally or alternately, can include a retaining element, such as, for example, the dovetail 185. A pair of retaining wings 186,187 are provided which protrude outwardly from each side of the base member 152. Mounting means are provided on the base member 152 for mounting the member 152 to a panel, such as, for example, a door panel, cabinet or doorway. The mounting means comprise apertures 154,155 which receive fastening members (not shown) therein for attachment to the panel surface. Preferably, the apertures 154,155 can be recessed within the base member 152, as shown in FIG. 20. Additionally, the apertures 154,155 can be provided in a hexagonal configuration to receive a hex nut or bolt head therein, as described above.

As shown in FIG. 18, the pin knuckle member 151 is provided with coupling means to secure the pin knuckle 151 to the base member 152. The coupling means is shown comprising retaining notches 191,192 which are matingly provided to receive the wings 186,187 of the dovetail 185 therein. As shown in FIG. 20, the dovetail 185 also includes a pair of guide flanges 193,194 which serve as rails over which the tracks 161,162, respectively, are guided for installation of the pin knuckle member 151 on the base member 152. The dovetail 185 preferably is installed by snapping the pin knuckle member 151 over the base 152 to force the wings 161,162 into position within the respective retaining notches 191,192. In the embodiment shown, the base member 152 can be mounted on a first hinging surface, such as, for example, a door, panel, door jamb or the like, and the pin knuckle 151 slidably mounted to the mounted base 152 by sliding it over the wings 186,187 of the dovetail 185.

Reference being made again to FIG. 18, the pivot knuckle 164 is provided having a housing 165 which includes receiving means such as, for example, the pin-receiving bore 167 which receives the pin member 158 of the pin-knuckle 151. In this embodiment, a second base member, which can comprise the base member 152, as described in relation to the pin knuckle 151, can be utilized for securing the pivot knuckle 164 to a panel, in the same manner. Thus, a pair of base members, such as those 152, in the hinge assembly 150 can secure the hinging members to a door or panel surface. Preferably, also shown, are locating stops comprising a plurality of locating detents 175,176,177,178 disposed longitudinally on the inner circumferential portion 179 of the bore 167. The locating detents 175,176,177,178 are circumferentially spaced apart. The pin 158 is provided with pawl means shown, for example, comprising a pawl member 180 having protruding elements 181, 182 which are resiliently provided to accommodate a force load directed axially to the center of the pin 158 upon receipt of which the elements 181, 182 recede into the pawl holding space 183. The force is generally provided by the inner wall 179 of the bore 167. The elements 181,182 return to their raised position (the FIG. 18 position) upon being rotated to align with one of the plurality of locating detents 175,176,177,178 on the longitudinal bore 167 to maintain the pin position until the pawl member 180 is forcibly moved (usually by the application of a further force applied to the swinging door panel to which the hinge assembly is attached). As described above, other pawl means can be used in connection with the invention, consistent with the spirit and scope thereof, including, for example, springs, torsional members, retracting members, and the like.

Preferably, as shown in FIG. 18, the housing 165 is secured to a base member 152. The base member 152 functions as described above. While not shown, it will be understood that the pivot knuckle 164 can be provided with coupling means, which, for example, can include track means with a pair of tracks on the pivot knuckle 164, for facilitating seating of the knuckle 164 on a base member 152, as described above. Therefore, it will be understood that a base member, such as that base member 152 which mounts the pin knuckle 151, can be used to mount the pivot knuckle 164 to a hinge panel in the manner described above in relation to the coupling of the base 152 and pin-knuckle member 151.

Referring to FIG. 21, an alternate embodiment of a hinge assembly 210 according to the present invention is shown. The hinge assembly 220 includes a pin knuckle 211 and a pivot knuckle 212. Base members 213 and 214 are provided respectively to secure the pin knuckle 211 and pivot knuckle 212 to respective panel members, such as, for example, a door panel and a frame or enclosure. The base members 213,214 can be provided as those described above. For example, the base members 213,214 can comprise the same configuration so that the same member can be utilized for mounting a pin knuckle or a pivot knuckle. The pin knuckle 211 includes a pin 215 extending therefrom. The pin 215 is shown comprising a conical configuration. A pin-receiving bore 216 is provided on the pivot knuckle 212 to receive the pin 215 therein. The pin 215 can pivot relative to the receiving bore 216. Mounting means is provided to mount the pin knuckle 211 and pivot knuckle 212 to respective base members 213,214. A dovetail configuration is shown provided on the base members 213,214. The base member 213 securing the pin knuckle includes wings 217,218 which are received in matingly configured recesses, respectively, 220, 221. Similarly, the dovetail configuration of the pivot knuckle base member 214 also includes wings 222 (only one side being shown) and a matingly configured recess 223 to secure the wing 222 therein. Furthermore, while not shown, the coupling means and retaining means described above in relation to alternate embodiments of the present invention, can be utilized with the hinge assembly 210 shown in FIG. 21 consistent with the disclosure herein.

Referring to FIG. 22, an alternate hinge assembly 230 is shown with a pin knuckle 231 having a pin 235 extending outwardly therefrom. A stationary cam 237 is provided having a bore 238 therethrough with retaining elements 240 thereon. The stationary cam 237 is further provided with a wave configuration 241 profiled at one end thereof. A moving cam 242 is provided with mounting means for fixedly mounting the member relative to the pin 235. Preferably, the mounting means comprises a square bore 243 which is matingly provided for disposal on the pin 235. As shown, preferably, the pin 235 comprises a configuration, such as, for example, the square configuration, which is keyed with the bore 243 of the moving cam 242. It is conceivable that other configurations can also be employed to fix the moving cam 242 relative to the pin 235. The moving cam 242 further comprises a matingly profiled wave configuration 244 at one end thereof for following the surface of the stationary cam profile 241. A pivot knuckle 232 is shown having a longitudinal bore 245 extending therethrough with retaining notches 246 disposed therein to receive the retaining elements 240 and hold them against relative movement. A spring member 247 is provided and biases against the anterior end 248 of the moving cam 242 and shaft button or spring loading element 250.

As shown in FIG. 23, the hinge assembly 230 is shown with the stationary cam 237 and moving cam 242 connected. The spring 247 is shown biasing the moving cam 242 into engagement with the stationary cam 237. When one of the pin knuckle 231 and pivot knuckle 232 is rotated with a hinge panel to which it is mounted, relative to the other of the pin knuckle 231 and pivot knuckle 232, the moving cam 242 is moved toward the loading element 250 to compress the spring 247. The pivot knuckle 232 retains the stationary cam 237 while the relative pivoting movement of the pin knuckle relative to the pivot knuckle 232 rotates the moving cam 242 throughout a series of predetermined stops provided by the mating of the wave profile surfaces, respectively, 241,244 of the stationary cam 237 and moving cam 242, respectively. Preferably, a shoulder 251 is provided to facilitate force load handling from one or more panel members. While not shown, it will be understood that the pin knuckle 231 and pivot knuckle 232 can be mounted with the mounting means described herein in relation to other embodiments of the invention. For example, a base member can be provided with connecting means for connecting to and securing the pin knuckle 231 and pivot knuckle 232 to a hinge panel, such as, for example, a door or other member.

Reference now being made to FIG. 24, an alternate pin member 310 with a pin adjustment means is shown. The pin member 310 includes a pivot portion 311 and a shaft 312. The shaft 312 is provided to be received within a pivot bushing 313 which is secured within a bore 314 of a pin knuckle member 315. Securing means is provided to retain the pin 310 within the pin knuckle 315. As shown the securing means preferably comprises a series of threads 316 on the bore of the bushing member 313 and a matingly threaded portion 317 of the pin shaft 312 which can be used to regulate the extension of the pivot portion 311 from the pivot knuckle 315. A retaining member 318 is also shown and can be used to facilitate retention of the pin 310 at the desired level. A pivot member 319 is shown having a bore therein 320 within which the pivot portion 311 of the pin can be received.

In another alternate embodiment shown in FIG. 25, a pin member 350 is provided including a pivot portion 351 and a shaft 352. The shaft 352 is provided with threads 353 thereon for receipt within a threaded bore 354 of a pin knuckle member 355. Securing means is provided to retain the pin 350 within the pin knuckle 355 at varying lengths of extension therefrom. The securing means is shown comprising a securing member 356 having threads thereon, which tightens against the pin knuckle 355 to retain the pin 350 therein.

These and other advantages of the present invention can be made consistent with the spirit and scope of the invention as disclosed in the Summary of the Invention, the Brief Description of the Drawing Figures, the Detailed Description of the Preferred Embodiments and the appended claims. While the above description constitutes the preferred embodiment of the present invention, it will be appreciated that the invention is subject to modification, variation and change, without departing from the proper scope or fair meaning of the present invention. In this regard, while the various features of the present invention have been shown and described in relation to a door and frame, it will be understood that many of these features are suitable in connection with hinging of other members.

What is claimed is:

1. A hinge assembly for connecting in a swinging relationship a first hinge panel and a second hinge panel, said hinge assembly comprising:

a) at least one base member having mounting means for mounting said base member on at least one of a first hinge panel and a second hinge panel;

b) a pin-carrying member having connecting means for connecting to a base member;

c) a pin carried by said pin-carrying member and being connected thereto, said pin extending outwardly from said pin-carrying member;

d) a pin-receiving member including a bore disposed therein for receiving the pin therein;

e) mounting means for mounting said pin-receiving member on one of a first hinge panel and a second hinge panel; and f) wherein at least one of said pin and said pin-receiving member is pivotally movable relative to the other.

2. The hinge assembly of claim 1, wherein said base member includes at least one connecting element for allowing said pin-carrying member connecting means to attach to said base member.

3. The hinge assembly of claim 1, wherein said pin includes pin adjustment means for adjusting the pin relative to the pin-carrying member.

4. The hinge assembly of claim 3, wherein said pin adjustment means comprises a threaded shaft portion provided on said pin, and a matingly threaded bore disposed in said pin-carrying member, wherein said pin threaded shaft portion is received within the threaded bore for connecting said pin to said pin-carrying member.

5. The hinge assembly of claim 4, further comprising a retaining member for retaining said pin at a predetermined position relative to the outward extension of the pin in relation to the pin-carrying member, said retaining member being selectively securable to retain said pin and removable to release said pin for positioning for adjustment relative to the pin-carrying member.

6. The hinge assembly of claim 5, wherein said pin further includes retractable pawl means extending therefrom, the assembly further comprising pivot stop means for stopping the pivot of the pin at one or more predetermined locations, said stop means comprising one or more longitudinal detents disposed in the bore of said pin-receiving member, wherein said pawl means is engagable with said detents.

7. The hinge assembly of claim 6, wherein said pawl means comprises a flexible member disposed in the pivot portion of said pin, said flexible member extending radially outwardly from said pivot portion and being collapsible when engaging with the bore of the pin-receiving member and extendible when aligned with any one of the detents disposed therein.

8. The hinge assembly of claim 3, wherein said pin adjustment means comprises a threaded shaft portion provided on said pin, and a bushing disposed in said pin-carrying member, said bushing having a threaded bore disposed therein for receiving the threaded shaft portion of said pin member therein, said pin being adjustably positionable with respect to said pin-carrying member to extend outwardly at different distances therefrom.

9. The hinge assembly of claim 3, wherein said pin comprises a pivot portion extending therefrom, and wherein said pin adjustment means comprises a torsional element, said torsional element including a vane extending axially along the pivot portion of the pin, said pin including a receiving zone adjacent to said vane for receiving said vane therein when said vane encounters the bore of the pin-receiving member, said pin-receiving member further including a plurality of longitudinally disposed recesses therein, said vane being resiliently provided to extend into one of said longitudinal recesses when aligned therewith and to collapse within the receiving zone of the pin when the vane is not aligned with a longitudinal recess.

10. The hinge assembly of claim 1, wherein said pin further includes pawl means extending therefrom, the assembly further comprising pivot stop means for stopping the pivot of the pin at one or more predetermined locations, said stop means comprising one or more longitudinal detents disposed in the bore of said pin-receiving member, wherein said pawl means is engagable with said detents.

11. The hinge assembly of claim 10, wherein said pawl means comprises a flexible member disposed in the pivot portion of said pin, said flexible member extending radially outwardly from said pivot portion and being collapsible when engaging with the bore of the pin-receiving member and extendible when aligned with any one of the detents disposed therein.

12. The hinge assembly of claim 1, wherein said connecting means for connecting said pin-carrying member to said base member comprises dovetail means.

13. The hinge assembly of claim 12, wherein said connecting means for connecting said pin-carrying member to said base member further comprises track means.

14. The hinge assembly of claim 12, wherein said dovetail means include a dovetail element provided on one of said base and said pin-carrying member, and a dovetail recess provided on the other of said base and said pin-carrying member, said dovetail element being matingly provided in relation to said dovetail recess for receipt therein.

15. The hinge assembly of claim 14, wherein said dovetail recess further comprises a flexible portion for facilitating installation of said pin-carrying member on said base member.

16. The hinge assembly of claim 1, wherein said base member mounting means comprises one or more apertures disposed in said base member.

17. The hinge assembly of claim 16, wherein said one or more aperture includes a shelf portion and a recessed portion.

18. The hinge assembly of claim 17, wherein said mounting means further comprises fastener means having a shaft portion and a head portion, said shaft extending through said aperture and said head being seated on said shelf portion within the recessed portion for disposal therein.

19. A hinge assembly for connecting in a swinging relationship a first hinge panel and a second hinge panel, said hinge assembly comprising:

a) at least one base member having mounting means for mounting said base member on at least one of a first hinge panel and a second hinge panel;

b) a pin-carrying member having a pin extending outwardly therefrom and mounting means for mounting said pin-carrying member on one of said first hinge panel and said second hinge panel;

c) a pin-receiving member including a bore disposed therein for receiving the pin therein;

d) connecting means for connecting said pin-receiving member to said base member; and e) wherein at least one of said pin and said pin-receiving member is mounted for pivotal movement in relation to the other.

20. The hinge assembly of claim 19, wherein said base member includes one or more connecting elements for allowing said pin-receiving member connecting means to attach thereto.

21. The hinge assembly of claim 19, wherein said pin includes pin adjustment means for adjusting the pin relative to the pin-carrying member.

22. The hinge assembly of claim 21, wherein said pin adjustment means comprises a threaded shaft portion provided on said pin, and a bushing disposed in said pin-carrying member, said bushing having a threaded bore disposed therein for receiving the threaded shaft portion of said pin member therein, said pin being adjustably positionable with respect to said pin-carrying member to extend outwardly at different distances therefrom.

23. The hinge assembly of claim 21, wherein said pin adjustment means comprises a threaded shaft portion provided on said pin, and a matingly threaded bore disposed in said pin-carrying member, wherein said pin threaded shaft portion is received within the threaded bore for connecting said pin to said pin-carrying member.

24. The hinge assembly of claim 23, further comprising a retaining member for retaining said pin at a predetermined position relative to the outward extension of the pin in relation to the pin-carrying member, said retaining member being selectively securable to retain said pin and removable to release said pin for positioning for adjustment relative to the pin-carrying member.

25. The hinge assembly of claim 24, wherein said pin further includes retractable pawl means extending therefrom, the assembly further comprising pivot stop means for stopping the pivot of the pin at one or more predetermined locations, said stop means comprising one or more longitudinal detents disposed in the bore of said pin-receiving member, wherein said pawl means is engagable with said detents.

26. The hinge assembly of claim 25, wherein said pawl means comprises a flexible member disposed in the pivot portion of said pin, said flexible member extending radially outwardly from said pivot portion and being collapsible when engaging with the bore of the pin-receiving member and extendible when aligned with any one of the detents disposed therein.

27. The hinge assembly of claim 25, wherein said pawl means includes means for engaging said bore of said pin-receiving member when said pin is rotated relative to said bore.

28. The hinge assembly of claim 27, wherein said pin comprises a pivot portion, and wherein said pawl means includes an insert cavity disposed within the pivot portion of said pin, and an insert including a first portion received within said insert cavity and at least a second portion outside of said insert cavity comprising a vane.

29. The hinge assembly of claim 28, wherein said insert cavity extends through the pivot portion of said pin and said insert includes at least a third portion outside of said insert cavity and comprising a second vane.

30. The hinge assembly of claim 27, wherein said insert cavity is substantially rectangular in cross-section.

31. The hinge assembly of claim 27, further including a spring within said insert cavity.

32. The hinge assembly of claim 31, wherein said spring comprises a coil spring.

33. The hinge assembly of claim 31, wherein said spring comprises elastomeric means.

34. The hinge assembly of claim 19, wherein said pin further includes pawl means extending therefrom, the assembly further comprising pivot stop means for stopping the pivot of the pin at one or more predetermined locations, said stop means comprising one or more longitudinal detents disposed in the bore of said pin-receiving member, wherein said pawl means is engagable with said detents.

35. The hinge assembly of claim 34, wherein said pawl means comprises a flexible member disposed in the pivot portion of said pin, said flexible member extending radially outwardly from said pivot portion and being collapsible when engaging with the bore of the pin-receiving member and extendible when aligned with any one of the detents disposed therein.

36. The hinge assembly of claim 19, wherein said connecting means for connecting said pin-receiving member to said base member comprises dovetail means.

37. The hinge assembly of claim 36, wherein said connecting means for connecting said pin-receiving member to said base member further comprises track means.

38. The hinge assembly of claim 36, wherein said dovetail means include a dovetail element provided on one of said base and said pin-receiving member, and a dovetail recess provided on the other of said base and said pin-receiving member, said dovetail element being matingly provided in relation to said dovetail recess for receipt therein.

39. The hinge assembly of claim 28, wherein said dovetail recess further comprises a flexible portion for facilitating installation of said dove-tail recess on said base member.

40. The hinge assembly of claim 36, further comprising pin adjustment means for adjusting the pin relative to the said pin-carrying member and said pin-receiving member.

41. The hinge assembly of claim 36, further comprising pin member having a conical shaped configuration, and wherein said pin-receiving member bore comprises a matingly configured conical recess.

42. The hinge assembly of claim 19, wherein said base member mounting means comprises one or more apertures disposed in said base member.

43. The hinge assembly of claim 42, wherein said one or more aperture includes a shelf portion and a recessed portion.

44. The hinge assembly of claim 43, wherein said mounting means further comprises fastener means having a shaft portion and a head portion, said shaft extending through said aperture and said head being seated on said shelf portion within the recessed portion for disposal therein.

45. A hinge assembly for connecting in a swinging relationship a first hinge panel and a second hinge panel, said hinge assembly comprising:

a) at least one base member having mounting means for mounting said base member on at least one of a first hinge panel and a second hinge panel;

b) pin-carrying member having a pin extending outwardly therefrom and mounting means for mounting said pin-carrying member on one of said first hinge panel and said second hinge panel;

c) a pin-receiving member including a bore disposed therein for receiving the pin therein;

d) connecting means for connecting at least one of said pin-carrying member and said pin-receiving member to a base member;

e) wherein at least one of said pin and said pin-receiving member is mounted for pivotal movement in relation to the other; and f) wherein said connecting means comprises dovetail means.

46. The hinge assembly of claim 45, wherein said dovetail means includes a dovetail element provided on one of said base and the other of at least one of said pin-carrying member and said pin-receiving member, and a dovetail recess provided on the other of said base and the other of at least one of said pin-carrying member and said pin-receiving member, said dovetail element being matingly provided in relation to said dovetail recess for receipt therein.

47. The hinge assembly of claim 46, wherein said connecting means further comprises track means for facilitating alignment of at least one of said pin-carrying member and said pin-receiving member which is to be installed on said base member.

48. The hinge assembly of claim 46, wherein at least one of said pin-carrying member and said pin-receiving member further comprises a flexible portion for facilitating installation on a base member.

49. A hinge assembly for mounting a first hinge panel relative to a second hinge panel for swinging movement thereabout, the hinge assembly comprising:

a) first hinge means including mounting means for mounting said first hinge means to one or the other of said first hinge panel and said second hinge panel;

b) second hinge means including mounting means for mounting said second hinge means to the other of said first hinge panel and said second hinge panel on which said first hinge means is mounted;

c) wherein one of said first hinge means and said second hinge means includes a pin extending outwardly therefrom;

d) wherein the other of said first hinge means and said second hinge means includes adjustment means for laterally and vertically adjusting said other of said first hinge means and said second hinge means;

e) said other of said first hinge means and said second hinge means including a first hinge part with mounting means for mounting said first hinge part to a first panel, and a second hinge part with mounting means for mounting said second hinge part to said first hinge part, there being on at least one or the other of said first hinge part and said second hinge part a pivot bore disposed therein which rotatably carries the pin therein; and f) wherein said adjustment means further comprising positioning means for positioning said first hinge part relative to said second hinge part.

50. The hinge assembly of claim 49, wherein said positioning means comprises a movable wedge member disposed in said other of said first hinge means and said second hinge means, there being a matingly provided fixed wedge element disposed on said other of said first and second hinge means in fixed relation to said movable wedge member.

51. The hinge assembly of claim 50, wherein said positioning means further comprises a vertical positioning member and a lateral positioning member for adjusting the other of said first hinge means and said second hinge means, respectively, in the vertical direction and in the lateral direction relative to one of said first hinge panel and said second hinge panel.

52. The hinge assembly of claim 51, wherein said vertical positioning member comprises a set screw having threads thereon, and wherein said movable wedge member includes a matingly threaded bore disposed therein to receive the set screw, said movable wedge member being positionable along a vertical range by turning said set screw.

53. The hinge assembly of claim 51, wherein said lateral positioning member comprises a clamping screw having threads thereon, and wherein said base member includes a matingly threaded bore disposed therein and aligned to receive the clamping screw, said movable wedge member having an aperture therein through which said clamping screw passes, said aperture being sufficient in length to permit the movement of the movable wedge member along a predetermined range.

54. The hinge assembly of claim 50, wherein said movable wedge member comprises a surface of stepped ridges, and wherein said fixed wedge element comprises a matingly associated surface of stepped ridges.

55. The hinge assembly of claim 50, wherein at least one of said first hinge means and said second hinge means further comprises installation facilitating means for facilitating the location of the hinge assembly relative to a hinge panel.

56. The hinge assembly of claim 55, wherein said installation facilitating means comprises a recess disposed in at least one of said first hinge means and said second hinge means, and wherein a matingly associated boss is provided on at least one or the other of said first panel and said second panel.

57. The hinge assembly of claim 49, wherein said pin includes pin adjustment means for adjusting the pin relative to the first and second hinge means.

58. The hinge assembly of claim 57, wherein said pin adjustment means comprises a threaded shaft portion provided on said pin, and a matingly threaded bore disposed in the one of said first hinge means and said second hinge means, wherein said pin threaded shaft portion is received within the threaded bore for connecting said pin therein.

59. The hinge assembly of claim 58, further comprising a retaining member for retaining said pin at a predetermined position relative to the outward extension of the pin from one of the first hinge means and the second hinge means, said retaining member being selectively securable to retain said pin and removable to release said pin for positioning for adjustment relative to said first hinge means and said second hinge means.

60. The hinge assembly of claim 59, wherein said pin further includes retractable pawl means extending therefrom, the assembly further comprising pivot stop means for stopping the pivot of the pin at one or more predetermined locations, said stop means comprising one or more longitudinal detents disposed in the pivot bore, wherein said pawl means is engagable with said detents.

61. The hinge assembly of claim 60, wherein said pawl means comprises a flexible member disposed in the pivot portion of said pin, said flexible member extending radially outwardly from said pivot portion and being collapsible when engaging with the pivot bore and extendible when aligned with any one of the pivot bore detents.

62. The hinge assembly of claim 60, further comprising means for adjusting the angle of a first hinge panel relative to a second hinge panel by regulating the predetermined pivot stop means.

63. The hinge assembly of claim 57, wherein said pin adjustment means comprises a threaded shaft portion provided on said pin, and a bushing disposed in one of said first hinge means and said second hinge means, said bushing having a threaded bore disposed therein for receiving the threaded shaft portion of said pin member therein, said pin being adjustably positionable with respect to said one of the first hinge means and second hinge means to extend outwardly at different distances therefrom.

64. The hinge assembly of claim 57, wherein said pin comprises a pivot portion extending therefrom, and wherein said pin adjustment means comprises a torsional element, said torsional element including a vane extending axially along the pivot portion of the pin, said pin including a receiving zone adjacent to said vane for receiving said vane therein when said vane encounters the pivot bore, said pivot bore further including a plurality of longitudinally disposed recesses therein, said vane being resiliently provided to extend into one of said longitudinal recesses when aligned therewith and to collapse within the receiving zone of the pin when the vane is not aligned with a longitudinal recess.

65. The hinge assembly of claim 49, wherein said pin further includes retractable pawl means extending therefrom, the assembly further comprising pivot stop means for stopping the pivot of the pin at one or more predetermined locations, said stop means comprising one or more longitudinal detents disposed in the pivot bore, wherein said pawl means is engagable with said detents.

66. The hinge assembly of claim 65, wherein said pawl means comprises a flexible member disposed in the pivot portion of said pin, said flexible member extending radially outwardly from said pivot portion and being collapsible when engaging with the pivot bore and extendible when aligned with any one of the pivot bore detents.

67. The hinge assembly of claim 49, further comprising means connecting said first hinge part with said second hinge part, said connecting means further comprising dovetail means.

68. The hinge assembly of claim 67, further comprising means connecting said first hinge part with said second hinge part, said connecting means further comprising track means.

69. The hinge assembly of claim 67, wherein said dovetail means include a dovetail element provided on one of said first hinge part and said second hinge part, and a dovetail recess provided on the other of said first hinge part and said second hinge part, said dovetail element being matingly provided in relation to said dovetail recess for receipt therein.

70. The hinge assembly of claim 69, wherein said means connecting said first hinge part with said second hinge part further comprises a flexible portion for facilitating installation disposed on the other of said first hinge part and said second hinge part which includes the dovetail recess.

71. The hinge assembly of claim 49, wherein mounting means which mounts the first hinge means and the second hinge means to one or the other of a first hinge panel and a second hinge panel comprises one or more apertures disposed therein.

72. The hinge assembly of claim 71, wherein said one or more aperture includes a shelf portion and a recessed portion.

73. The hinge assembly of claim 72, wherein said mounting means further comprises fastener means having a shaft portion and a head portion, said shaft extending through said aperture and said head being seated on said shelf portion within the recessed portion for disposal therein.

74. The hinge assembly of claim 49, wherein said pin further comprises means for facilitating force distribution.

75. The hinge assembly of claim 74, wherein said means for facilitating force distribution comprises an annular shoulder portion disposed on said pin.

76. A hinge assembly for connecting a first hinge panel to a second hinge panel in a swinging relationship, said hinge assembly comprising:

a) a pair of base members, each base member having mounting means for mounting said base member on at least one of a first hinge panel and a second hinge panel;

b) a pin-carrying member having connecting means for connecting to a base member;

c) a pin carried by said pin-carrying member and extending outwardly therefrom, wherein said pin includes a threaded portion and a pivot portion, said threaded portion being connected to the threaded bore of said pin-carrying member; said pin being adjustably provided in relation to the pin-carrying member;

d) pin adjustment means for adjusting the outward extension of the pin relative to the pin-carrying member, said pin adjustment means comprising a threaded bore disposed in said pin-carrying member and a threaded portion provided on said pin, wherein said pin is screwed into the threaded bore for connecting said pin to said pincarrying member; said pin adjustment means further comprising a threaded retaining member which is received on said threaded portion of said pin to secure said pin to said pin-receiving member;

e) pin-receiving means including a pivot member having a bore therein for receiving the pivot portion of the pin to permit relative rotation thereabout, said pin-receiving means including connecting means for connecting said pivot member to a base member, said bore having a plurality of longitudinally disposed recesses therein;

f) wherein said connecting means for connecting said pin-carrying member to a base member includes a dovetail element and guide flanges disposed on said base member, said pin-carrying member including track means with a pair of tracks and a notched recess to receive the dovetail element therein;

g) said pin-carrying member having at least a portion thereof which is flexibly provided to expand to snap over the dovetail element when the pin-carrying member is installed on the base member;

h) adjustment means for adjusting the position of the pin-receiving means relative to the pin-carrying member and pin carried thereby, said adjustment means including a first adjustment means for adjusting the position of the pin-receiving means relative to the longitudinal height of a first panel or a second panel, and including a second adjustment means for adjusting the position of the pin-receiving means relative to the lateral distance from the first or second panel;

i) wherein said adjustment means comprises a positioning member disposed in the pin-receiving member, said positioning member including a means for moving said positioning member in the longitudinal direction and means for moving said positioning member in the lateral direction, said positioning member including a movable wedge element, and wherein said pin-receiving means includes a matingly provided wedge element which is stationary relative to said pin-receiving member; and j) pivot control means for controlling the pivot of a movable panel to provide discrete stops between open and closed positions, said pivot control means comprising pawl means provided on said pin member, said pawl means including at least one protruding vane disposed axially thereon for engagement with said longitudinal recesses of said bore.

77. A hinge assembly for mounting a first hinge panel relative to a second hinge panel for swinging movement thereabout, the hinge assembly comprising:

a) first hinge means including mounting means for mounting said first hinge means to one or the other of said first hinge panel and said second hinge panel;

b) second hinge means including mounting means for mounting said second hinge means to the other of said first hinge panel and said second hinge panel on which said first hinge means is mounted;

c) wherein one of said first hinge means and said second hinge means includes a pin extending outwardly therefrom, there being a relative pivot relationship between said first hinge means and said second hinge means wherein one of said first hinge means and said second hinge means pivots throughout a radial range of rotation relative to the other;

d) stop means for maintaining one of said first and second hinge parts in one or more of a plurality of predetermined positions throughout the radial range of rotation, said stop means comprising:

(i) stationary cam means having a first engaging surface;

(ii) moving cam means disposed on said pin for radial movement therewith, and for axial movement relative to said pin, said moving cam means including a second engaging surface which is disposed for engagement with said first engaging surface; and (iii) biasing means for biasing said moving cam into engagement with said stationary cam in the axial direction long said pin axis; and e) wherein said stationary cam means is carried by the other of said first hinge means and said second hinge means relative to that one including the pin extending therefrom, said stationary cam means being stationary relative to said moving cam means.

78. The hinge assembly of claim 77, wherein at least one of said first hinge means mounting means and said second hinge means mounting means comprises a base member adapted to carry said pin.

79. The hinge assembly of claim 78, wherein at least one of said first hinge means mounting means and said second hinge means mounting means further includes dovetail means for connecting said at least one of the first hinge means and the second hinge means with said base member.

80. The hinge assembly of claim 77, wherein said first engaging surface comprises a wave configuration, and wherein said second configuration comprises mating wave configuration.

81. The hinge assembly of claim 77, wherein said stationary cam means is integrally provided on the other of said first hinge means and said second hinge means relative to that one including the pin extending therefrom.

82. The hinge assembly of claim 77, further comprising retaining means for retaining said stationary cam means on the other of said first hinge means and said second hinge means relative to that one including the pin extending therefrom.

83. The hinge assembly of claim 82, further comprising adjustment means for laterally and vertically adjusting said other of said first hinge means and said second hinge means.

* * * * *